US009389050B1

(12) United States Patent
Chen

(10) Patent No.: US 9,389,050 B1
(45) Date of Patent: Jul. 12, 2016

(54) TARGET THROWING DEVICE

(71) Applicant: Xiao Ming Chen, Tai Shan (CN)

(72) Inventor: Xiao Ming Chen, Tai Shan (CN)

( * ) Notice: Subject to any disclaimer, the term of this patent is extended or adjusted under 35 U.S.C. 154(b) by 200 days.

(21) Appl. No.: 13/987,358

(22) Filed: Jul. 16, 2013

Related U.S. Application Data

(60) Provisional application No. 61/741,431, filed on Jul. 19, 2012.

(51) Int. Cl.
*F41J 9/18* (2006.01)
*F41J 9/30* (2006.01)

(52) U.S. Cl.
CPC ..... *F41J 9/18* (2013.01); *F41J 9/30* (2013.01)

(58) Field of Classification Search
CPC ..... F41J 9/30; F41J 9/18
USPC ..... 124/6, 8, 9, 43, 46, 47, 50
See application file for complete search history.

(56) References Cited

U.S. PATENT DOCUMENTS 1,552,191 A * 9/1925 Bahlmann ..... F41J 9/30 124/26
2,934,056 A * 4/1960 Lauterbach ..... F41J 9/30 124/43
3,225,754 A * 12/1965 Foster ..... F41J 9/30 124/9
3,304,928 A * 2/1967 Darrell ..... F41J 9/30 124/47
3,601,112 A * 8/1971 Dale ..... F41J 9/20 124/8
3,822,688 A * 7/1974 Mayne ..... A63B 69/0026 124/42
3,841,293 A * 10/1974 Laporte ..... F41J 9/30 124/50
3,923,033 A * 12/1975 Laporte ..... F41J 9/24 124/32
3,937,203 A * 2/1976 Riedmueller ..... F41J 9/30 124/43
4,048,976 A * 9/1977 Alday ..... F41J 9/30 124/47
4,146,008 A * 3/1979 Rowlands ..... F41J 9/18 124/43
4,481,932 A * 11/1984 Olson ..... F41J 9/20 124/43
4,706,641 A * 11/1987 Cote ..... F41J 9/30 124/32
4,747,390 A * 5/1988 Storm ..... F41J 9/30 124/47
4,967,720 A * 11/1990 McCord ..... F41J 9/30 124/47
5,036,828 A * 8/1991 Heffer ..... F41J 9/30 124/47
5,249,563 A * 10/1993 Patenaude ..... F41J 9/30 124/46
5,406,928 A * 4/1995 Panara ..... F41J 9/30 124/47
5,427,380 A * 6/1995 Hazard ..... F41J 9/18 124/32
5,720,664 A * 2/1998 Brubacher ..... F41J 9/24 124/8
5,771,874 A * 6/1998 Kohler ..... F41J 9/30 124/51.1
5,871,003 A * 2/1999 Laporte ..... F41J 9/30 124/8
5,937,839 A * 8/1999 Nilsson ..... F41J 9/24 124/8
5,947,101 A * 9/1999 Kerr ..... F41B 4/00 124/78
5,970,969 A * 10/1999 Anttila ..... F41J 9/30 124/8
6,026,796 A * 2/2000 LaPorte ..... F41J 9/18 124/7
6,159,112 A * 12/2000 Ciluffo ..... A63B 69/0024 124/4
6,176,229 B1 * 1/2001 Patenaude ..... F41B 3/04 124/8
6,276,350 B1 * 8/2001 Davey ..... F41J 9/18 124/8
6,431,161 B1 * 8/2002 Gustafsson ..... F41J 9/30 124/8
6,588,410 B1 * 7/2003 Graber ..... F41J 9/24 124/8
6,758,203 B1 * 7/2004 Wu ..... F41J 9/18 124/6
7,263,986 B2 * 9/2007 Lovell ..... F41J 9/30 124/9
9,004,055 B2 * 4/2015 Laporte ..... F41J 9/18 124/42
2012/0138034 A1 * 6/2012 Whidborne ..... F41J 9/30 124/8

* cited by examiner

*Primary Examiner* — Alexander Niconovich
(74) *Attorney, Agent, or Firm* — M. Paul Hendrickson

(57) ABSTRACT

The present invention provides a target throwing device which can throw a single or multiple shooting targets with a single throwing arm. The device includes a dispensing unit for dispensing a desired number of targets onto a throwing arm containing multiple rails or an adjustable rail to provide the appropriate orientation and momentum for the desired number of targets to be thrown by the throwing arm.

20 Claims, 18 Drawing Sheets

TARGET THROWING DEVICE

This application is a non-provisional application of earlier filed provisional application No. 61/741,431, entitled "Target Throwing Device", filed on behalf of Xiao Ming Chen, on Jul. 19, 2012, the contents of which are made a part of and incorporated by reference herein.

FIELD OF INVENTION

The present invention relates to throwing devices and more particularly to target shooting throwing devices and the use thereof.

BACKGROUND OF THE INVENTION

Target shooting has become more sophisticated over the past generations. Early target shooting relied upon manually throwing objects into the air which were then targeted by the gun shooter. As the sport developed, more sophisticated throwing devices and targets were developed. Some of the target throwing device functions as a manual whip which propels the target into the air by manually using the whip with a throwing motion. Early mechanical versions required a device whereby an operator would place each clay pigeon upon the throwing member such as a throwing arm which upon mechanical activation would then throw the clay pigeon for targeting.

The more current devices rely upon a target throwing device which feeds a single disc or target from a feeding column stacked with targeting discs through a port onto a revolving tray or bed upon which a throwing arm typically trails. These target throwing devices generally rely upon a single throwing arm, a single dispensing port equipped with downwardly extending stiff synthetic filaments for guiding a single target onto the bed or tray of the shooting arm. The columns of shooting targets are commonly stacked within a column support generally comprising four upwardly mounted metal posts positioned above the dispensing port. A mechanical plate or gate synchronized with the revolving movement of the receiving bed and the throwing arm opens and shuts at the appropriate time when the receiving bed revolves beneath the throwing arm receiving bed. A plunger type piston engages the next to bottom target in timed sequence with a revolving receiving bed upon which the throwing arm is positioned and drops the bottom target onto the receiving bed for engagement onto a revolving throwing arm. The throwing arm is typically fitted with a longitudinally extending, blunted, rubber rail which engages onto the dropped target. The throwing arm is generally positioned in the non-throwing position at an outwardly obtuse angular position so that the target tends to gravitationally roll outwardly along the rail so as to create a spinning motion upon the target by the time it is thrown by the throwing arm. These target shooting devices have typically been equipped with a single target ejecting port and a single throwing arm adapted to engage and throw only a single shooting target at one time. Notwithstanding decades of target shooting use, there does not exists a target throwing device capable of throwing multiple targets on a single throw.

There exist a few variations whereby these single target throwing machines have been modified so as to throw two separate discs or targets in tandem. Such multiple target throwing devices operate generally in the same manner except, there exists two separate ports and target retaining columns and two separate dispensers for dispensing the targets onto the throwing arm tray in sequence to each of the two throwing arms so as to consecutively throw the two targets. The manner in which the targets are injected onto the receiving tray and carried individually by each of the two arms equipped with a blunt edged target engaging rubberized rail essentially the same as used in the single target throwing devices. These dual target throwing devices are essentially a combination of single throwing device with duplicate parts (e.g. dual ports, arms, dispensers, etc.) constituting two throwing devices combined into one. The manufacture of these multiple target throwing devices is relatively expensive since their manufacture requires the duplication and integration of relatively expensive operable components into the single target throwing device. They are uncommonly used except for the most expensive and sophisticated shooting ranges. The dual throwing devices cannot simultaneously throw two targets at one time.

Shooting targets were historically referred to as "clay pigeons" because they were originally constructed of molded clay. Shooting targets are now constructed of a variety of different synthetic and natural materials designed to undertake a flight pattern similar to a thrown discus and shatter upon being hit with a targeting shot. Such "clay pigeons" are available in a variety of sizes but generally rely upon similar outer and inner contours so as to effectively operate with most mechanical target throwing devices and provide the desired flight pattern and target.

Shooting targets are generally characterized as solids having an internal hollow concave contour and a ridged external surface comprised of a plurality of progressively declining concentric rims stacked upon one another and capped by a dome. The outer concentric rimmed contour and dome capped structure allows the shooting targets to be neatly stacked, shipped and columned for shooting by the shooting device. The inner surface of the shooting target includes a smoother concave structure capped with a convexular dome.

SUMMARY OF THE INVENTION

There exists a current need to provide a target shooting device which would simplify the operative components but yet provide the capabilities of dispensing and throwing a single target as well as multiple targets with a single throwing arm. This would be especially beneficial if such a device would overcome the age old problem of duplicating or adding more expensive operative components for each added target to be thrown by the device. The present invention provides a device having the capabilities of throwing one or more targets utilizing a single target dispensing unit adjustably for the dispensing of one or more targets onto a single throwing unit so as to present one or more airborne targets for targeting practice.

The unique target throwing device of this invention is adapted to simultaneously throw one or more shooting targets on a single throw. The target throwing device includes a target retaining member for retaining multiple shooting targets for throwing by the device, an adjustable target dispensing unit adjustably equipped to dispense a desired number of shooting targets from said retaining member onto a throwing unit fitted with a sufficient number of positional guides so as to positionally maintain the desired number of shooting targets dispensed thereto in position for throwing by the throwing unit, and a propelling member operationally connected to the throwing unit so as to throw the desired number of shooting targets to a targeting position. The device may be incorporated into conventional throwing devices equipped with a shooting target retainer for feeding a single target from a stacked column of shooting targets, an ejector adapted to eject a single shooting target from the stacked targets through a port equipped at the discharge port side with stiff plastic bristles which serve to guide the ejected shooting target onto a target retaining tray equipped with a throwing arm. The throwing arm is typically equipped with a shooting target ejecting spring which upon cam activation abruptly propels the throwing arm forward with substantial force to launch the single shooting target to a shooting position.

Conventional target throwing devices are incapable of simultaneously throwing two or more targets with a single throw. It has been unexpectedly discovered that the present throwing device makes it possible to present two or more shooting targets to a single throwing arm and simultaneously throw the presented multiple shooting targets to provide an exceptional multiple target flight pattern for target shooting.

The target throwing device includes an adjustable dispensing member which presents a desired number of shooting targets to the throwing unit for launching the desired number of targets to the target positioning. This requires an adjustable dispensing member capable of presenting one or more targets to the throwing unit and a throwing unit having the capability to receive and retain the presented target or targets in operational coordination with the throwing unit so as to create an effective flight pattern for the thrown target.

The target throwing device of this invention has the capacity to throw simultaneously one or more shooting targets. Unlike conventional target throwing devices which rely upon multiple arms each of which throws a single target, the present device relies upon a single throwing arm to throw multiple targets or, if desired, a single target all of which with superior throwing efficacy.

DETAILED DESCRIPTION OF THE INVENTION

Figure 1:
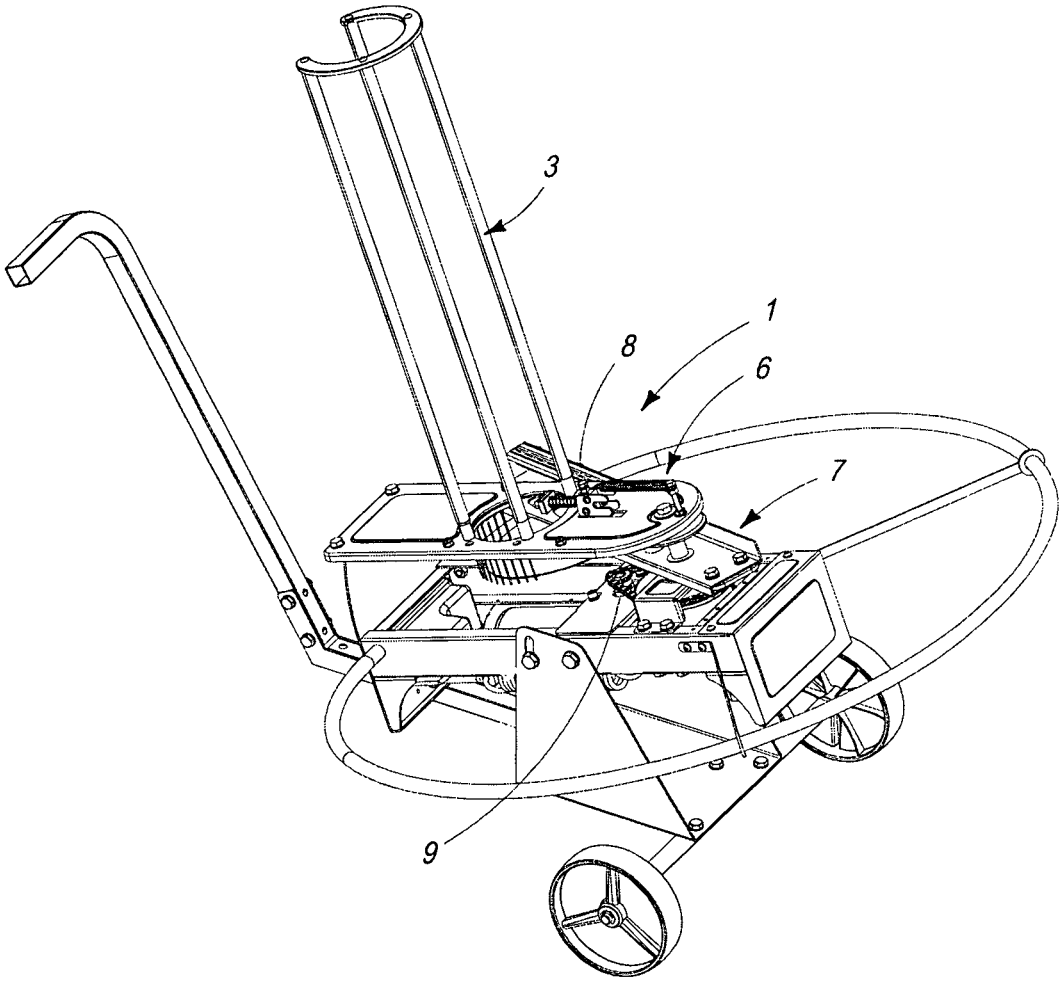
FIG. 1 is an isometric elevated side view of the target throwing device of this invention.

With reference to my provisional application Ser. No. 61/741,431 and the Figures herein; there is provided pursuant to the present invention a target throwing device 1 adapted to simultaneously throw one or more shooting targets T on a single throw. The target throwing device 1 comprises a shooting target retaining member 3 for retaining multiple shooting targets T for throwing by the device 1, an adjustable target dispensing unit 6 adjustably equipped to dispense a predetermined or desired number of shooting targets T from said retaining member 3 onto a throwing unit 7 fitted with a sufficient number of positional guides (generally prefixed by 8) so as to maintain the desired number of shooting targets T presented for throwing by the throwing unit 7 in an operational condition for throwing, and a propelling member 9 operationally connected to the throwing unit 7 so as to throw the desired number of shooting targets T to a targeting position.

Both the adjustable dispensing unit 6 and guide 8 may be provided in a form which permits both to be adjusted either mechanically or remotely. For example, the adjustable dispensing unit 6 may constitute a single adjustable stop 6S or multiple stops (e.g. $\mathbf{6}S_1$ & $\mathbf{6}S_2$, etc.) which allow passage of the desired targets T from the stacked target column C. Similarly, a single adjustable guide capable of presenting a target T or multiple targets T in proper orientation for throwing may be used. In the case of a single guide, the guide 8 (e.g. such as a single rail) may be adjusted upwardly or downwardly so as to mate onto the appropriate rimmed index of the targets T to be presented to the throwing unit 7 with the guide or guides thereby operationally maintaining the targets T in appropriate condition for target throwing.

With further reference to the Figures, the depicted target throwing device 1 is adapted to simultaneously throw one or more shooting targets T on a single throw. The target throwing device 1 departs from prior art devices in that the present device 1 has the capabilities of selectively throwing one or more shooting targets T by a single throwing unit 7 fed by an adjustable target dispensing unit 6 adjustable so as to dispense one or more targets T to the throwing unit 7 as illustratively depicted by FIGS. 4-8, 12-13 and 15. The adjustability features may be provided in the form of the two or more guide rails 8 preset upon the throwing arm 7 to accommodate two or more targets T. Current target throwing devices cannot dispense two or more targets T with a single throwing unit 7 (e.g. a throwing arm 7) or simultaneously throw therewith multiple targets T.

Figure 4:
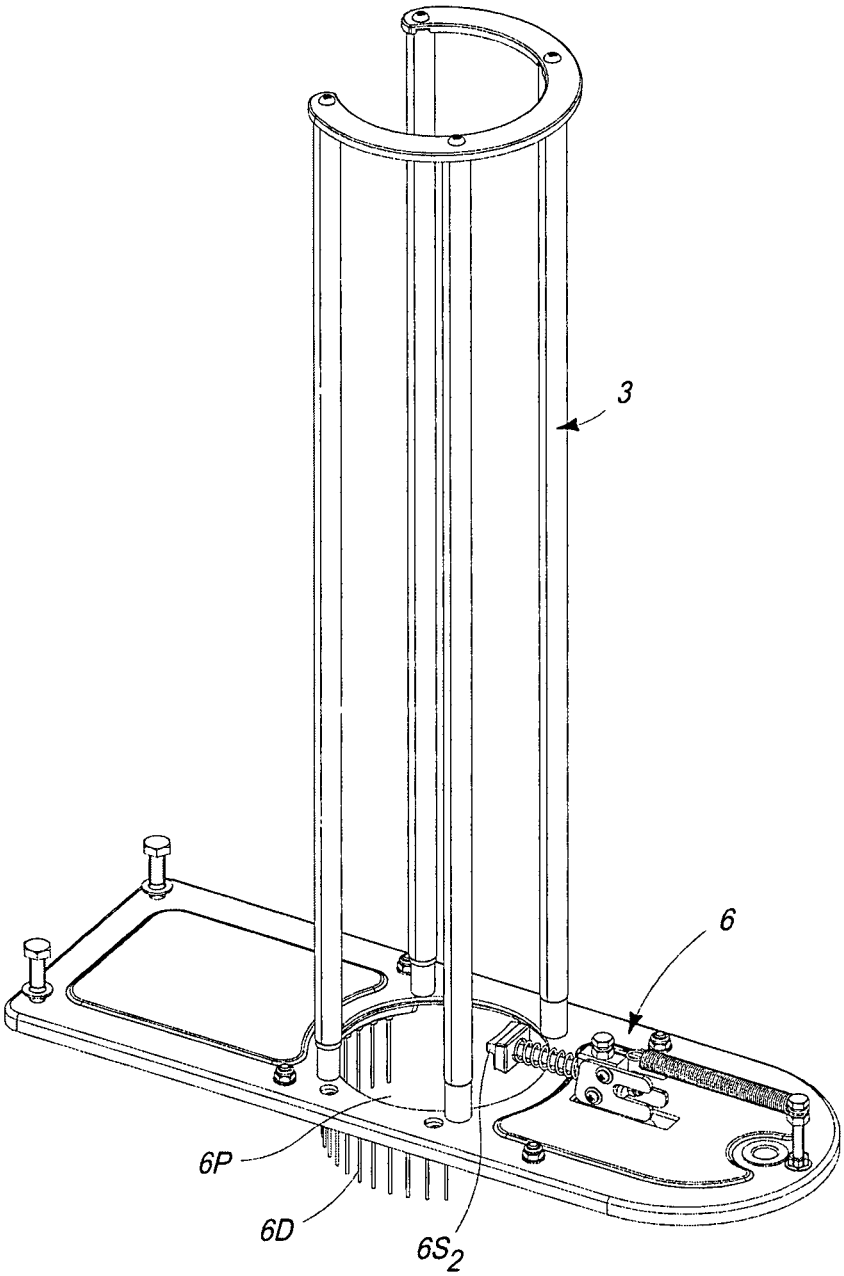
FIG. 4 depicts an isometric view of the dispensing unit shown in FIG. 3 adjusted to a position to dispense two shooting targets from the target retaining unit.
Figure 4A:
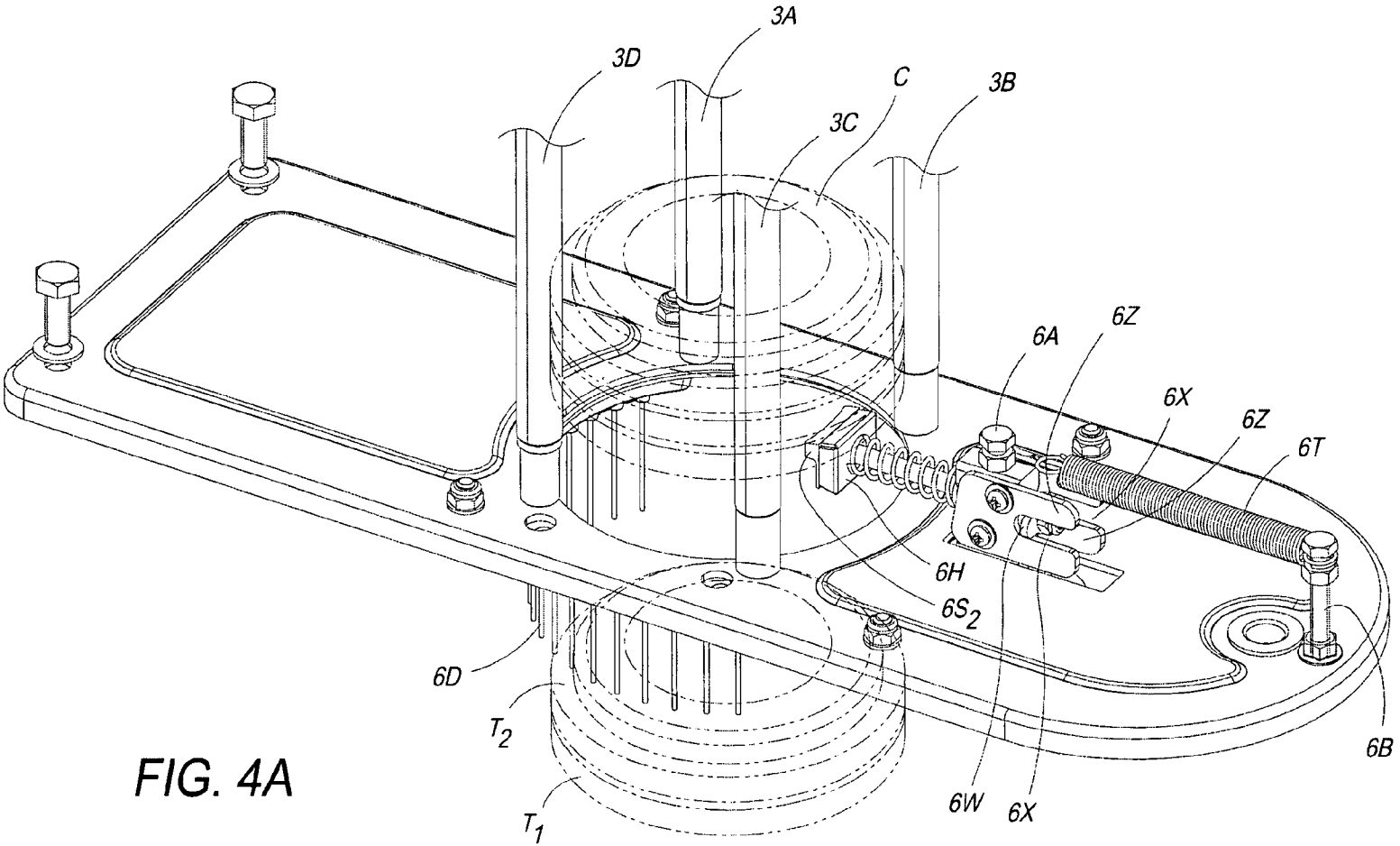
FIG. 4A is an enlarged view showing the dispensing unit of FIG. 4 dispensing two phantom lined targets.
Figure 5:
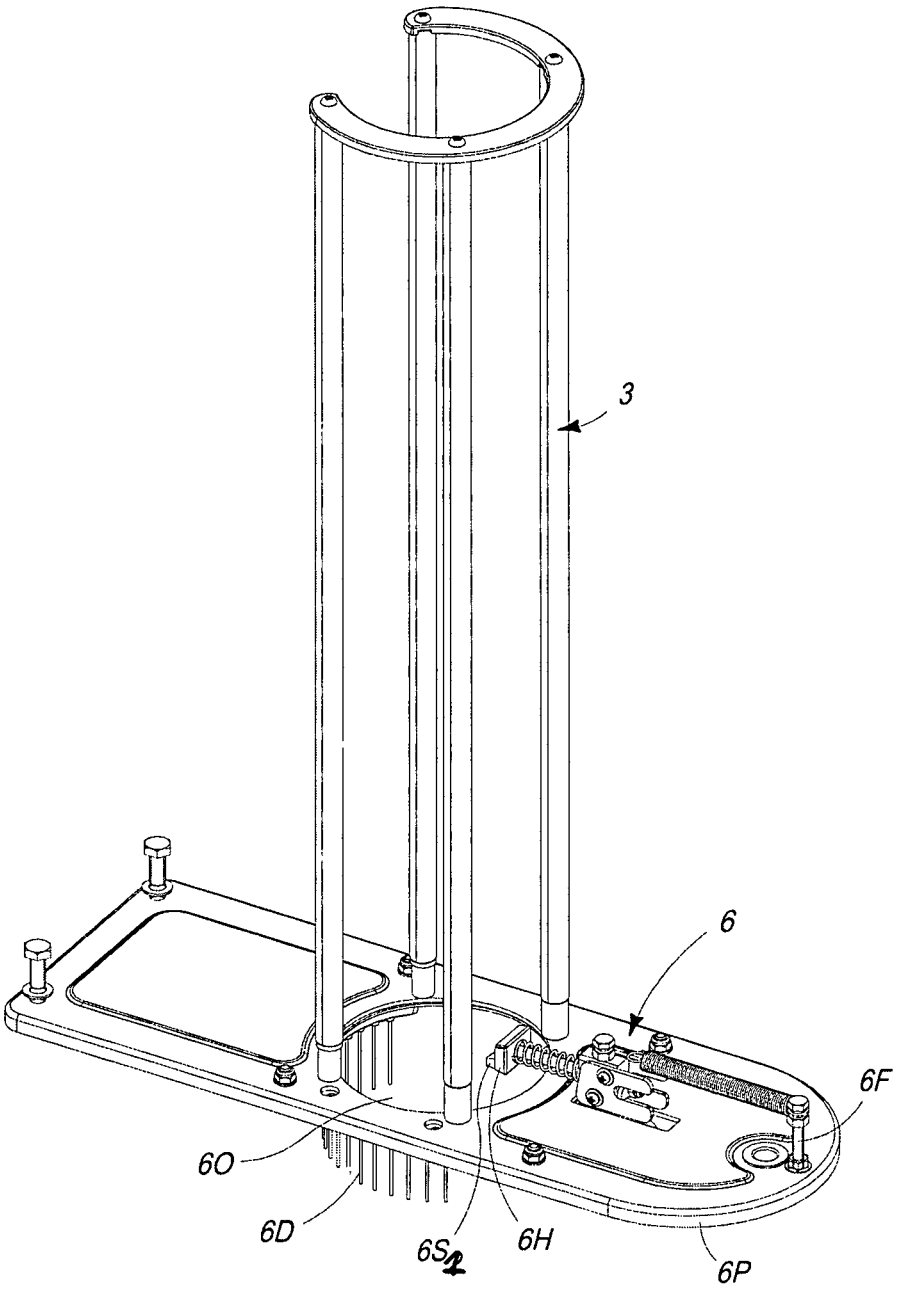
FIG. 5 is the same view as FIG. 4 except the dispensing unit is depicted as being adjusted to dispense one shooting target.
Figure 5A:
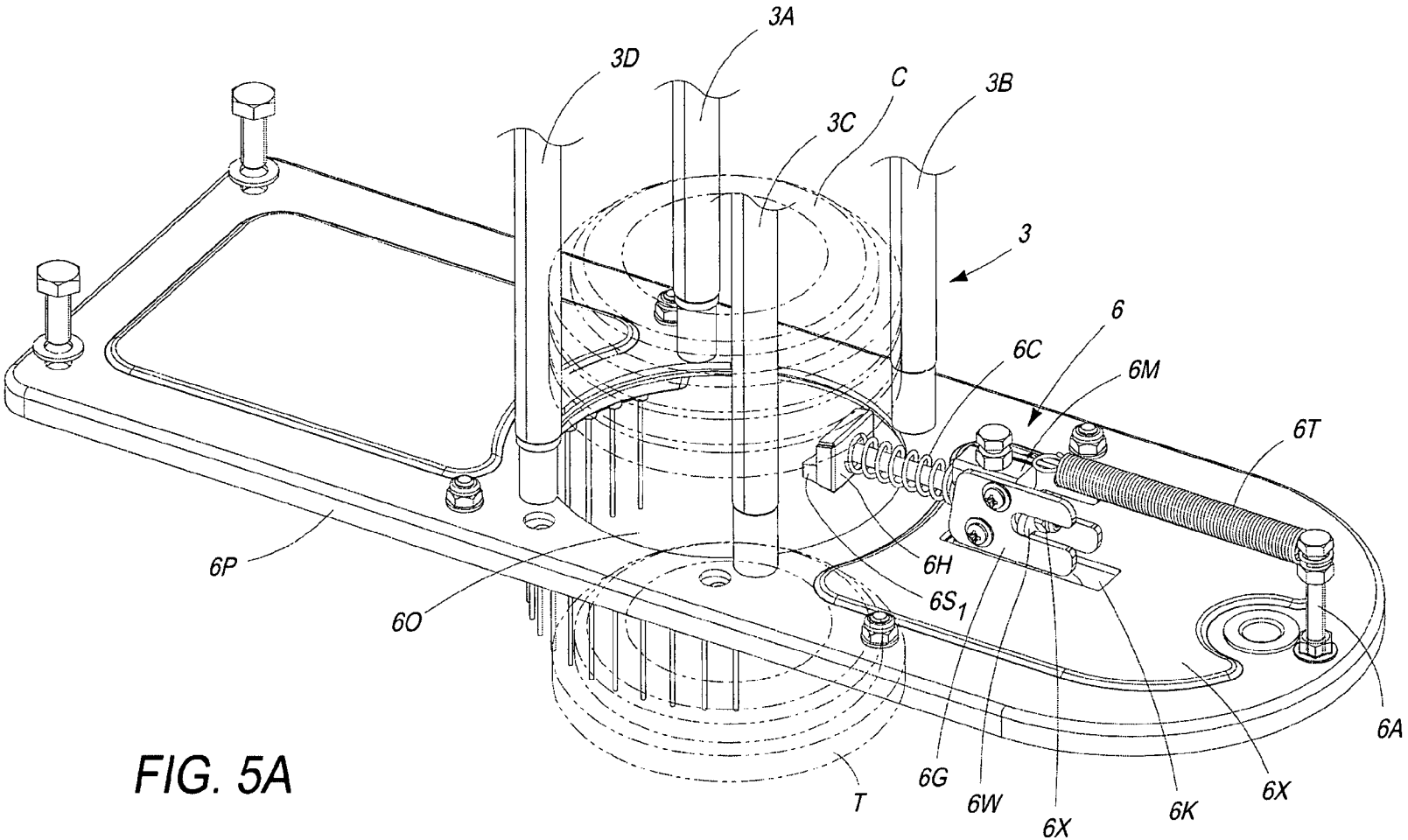
FIG. 5A is a partial enlarged view of FIG. 5 showing by phantom lines the dispensing of one target.

With reference to FIGS. 4-8 (inclusive of 4A and 5A), the adjustable dispensing unit 6 includes adjustability features which allows the operator of the throwing device 1 to select the number of targets T to be thrown by the target throwing device 1. The adjustable dispensing unit 6 and a positioning of the appropriate guide site S when using a single adjustable guide site or rail may be accomplished by automated remote RC means for selecting the number of desired targets T to be dispensed and thrown (e.g. see FIGS. 6-8) and the appropriate guide site 8 setting or such as by a manual manipulation or mechanical adjustment of the target dispensing unit 6 as illustratively shown by FIGS. 4, 4A, 5, and 5A. Since automated versions are generally more costly, many sportsmen may prefer to use a less costly, but highly effective dispensing unit 6 such as shown in FIGS. 1-5. The adjustable target dispensing unit 6 as depicted in FIGS. 1-5 utilize a manually adjustable head 6H and stop 6S equipped by adjustable positioning to dispense one target T or two targets. This is accomplished by adjusting the stop 6S so as to dispense a desired number of shooting targets T from the stacking column C of stacked targets T held between stacking posts 3A, 3B, 3C, & 3D of the target retaining member 3. FIGS. 4 and 4A depicts the dispensing unit 6 adjusted to dispense two targets T while FIGS. 5 and 5A shows the dispensing of one target T.

Figure 6:
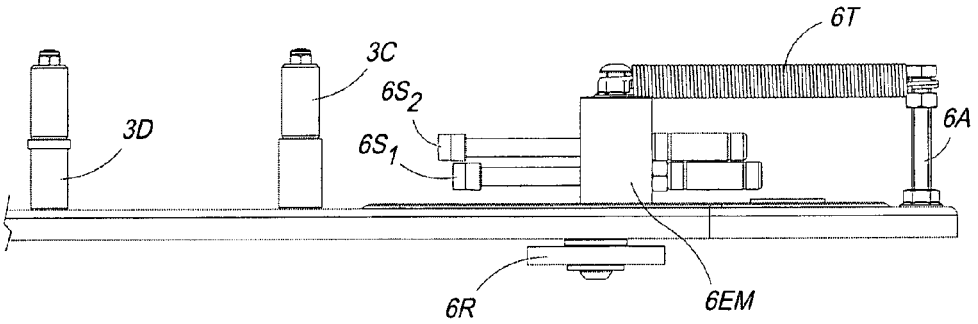
FIG. 6 is a side view of a dispensing unit positioned to dispense two targets with a solenoid actuated dispensing unit.
Figure 7:
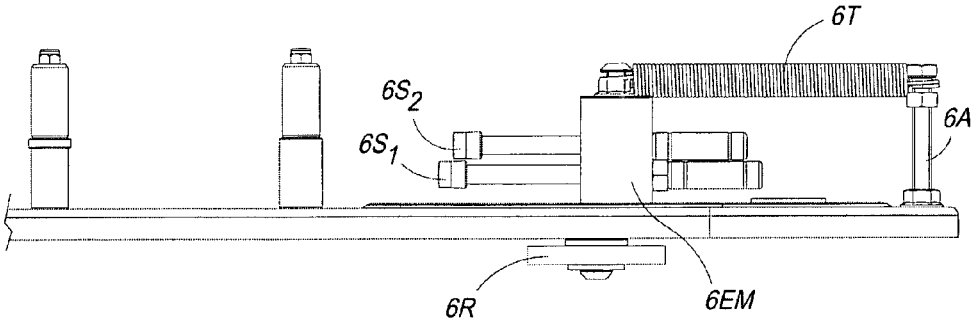
FIG. 7 is a side view of FIG. 6 except for the solenoid dispensing unit being adjusted to dispense one shooting target for throwing by the throwing unit.
Figure 8:
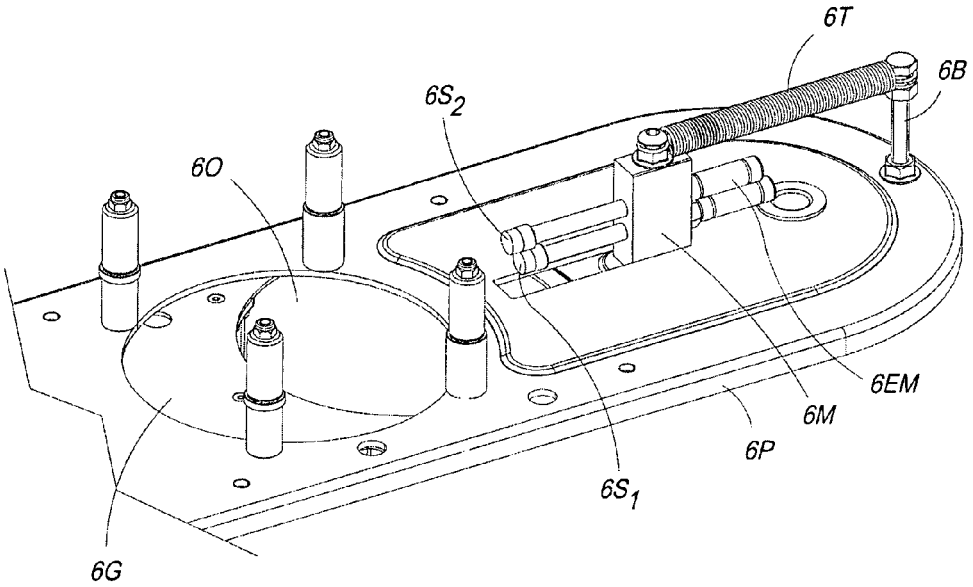
FIG. 8 is an isometric top view of FIG. 6 depicting the solenoid operated dispensing unit adjusted to dispense two shooting targets.
Figure 9:
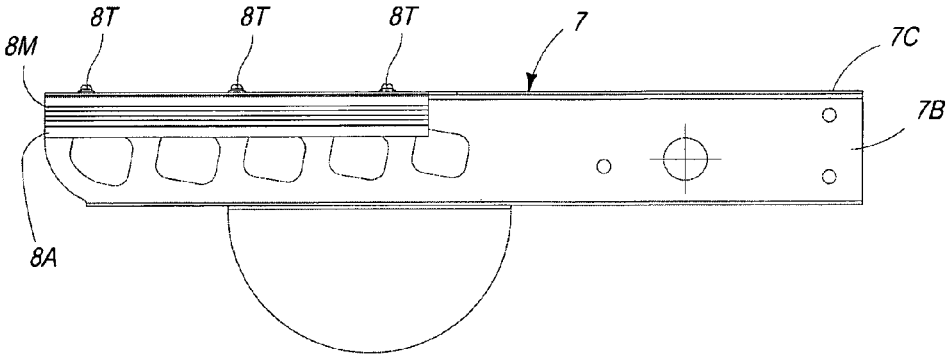
FIG. 9 is a top view of a target throwing arm shown in FIGS. 1 and 2 equipped with guide rails for simultaneously throwing two targets.
Figure 10:
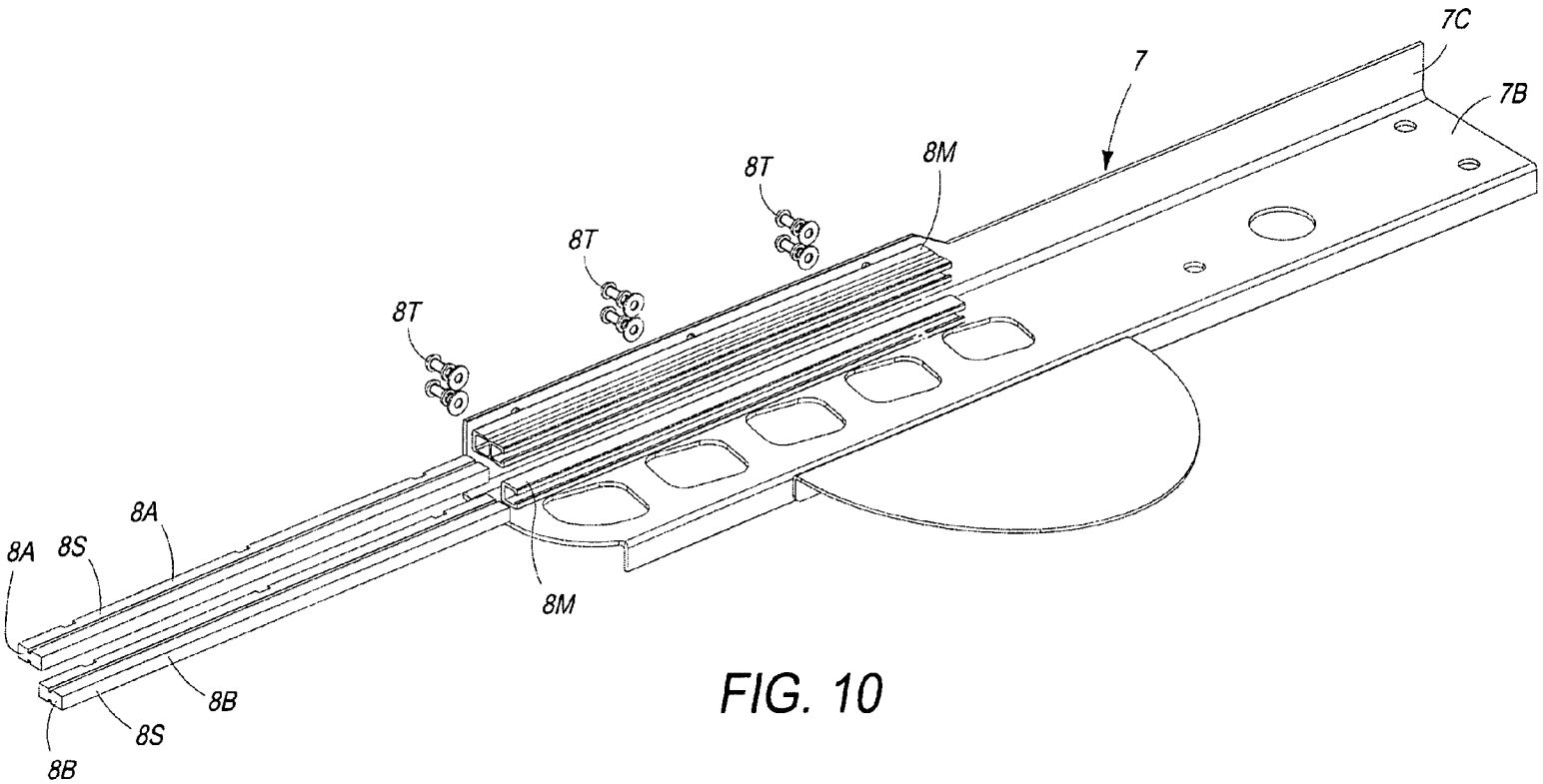
FIG. 10 is another view of FIG. 9 showing a partially disassembled view of the guide rails shown in FIG. 9.
Figure 17:
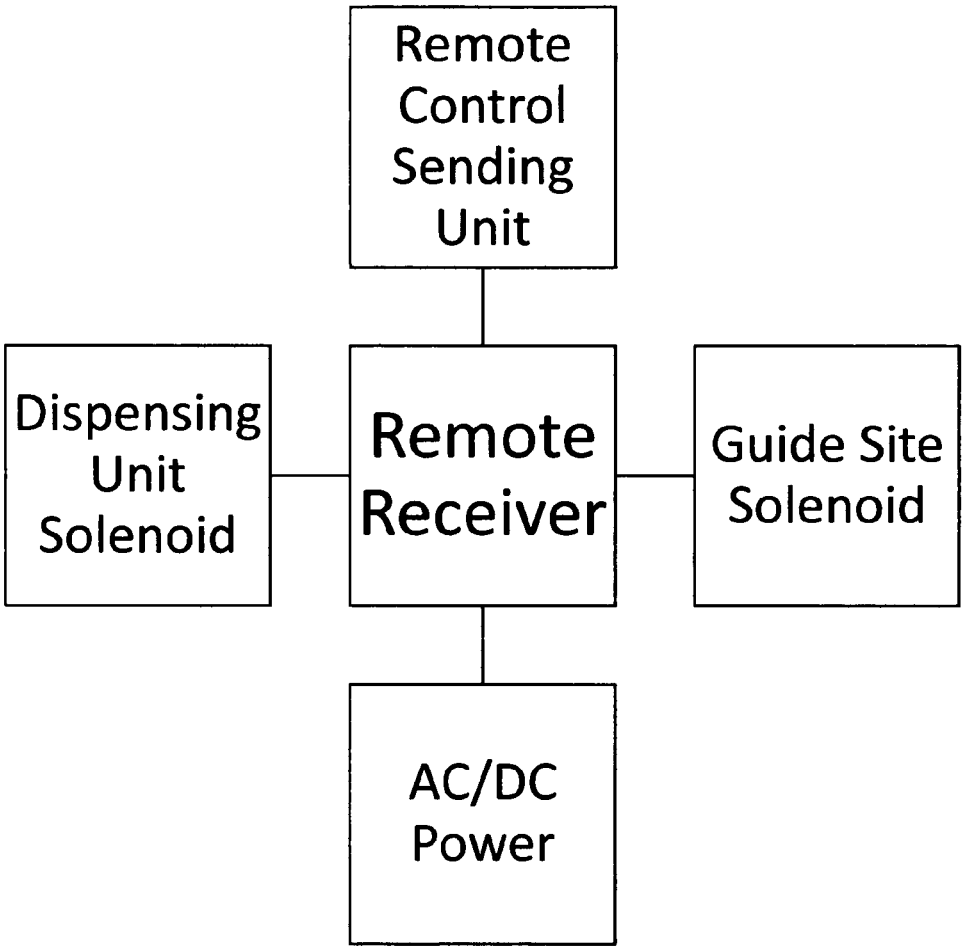
FIG. 17 is a schematic drawing representing a remote control of the target shooting device.

FIGS. 6-8 alternatively illustrate a dispensing unit 6 which relies upon a pair of solenoids or any other electromagnetic driving member $\mathbf{6}_{EM}$ suitably adaptable to remote control such as currently used in conventional remote controlled systems. As may be observed from FIGS. 7 and 8, the positioning of the two electromagnetic driven stops $\mathbf{6}S_1$, or $\mathbf{6}S_2$ determines whether one or two clay targets T will be dispensed by the target shooting dispensing unit 6. When the uppermost stop $\mathbf{6}S_2$ is forwardly positioned as shown in FIGS. 6 and 8, the dispensing unit 6 will dispense two clay targets T while forwardly activating the lower solenoid $\mathbf{6}S_1$ and deactivating the upper solenoid $\mathbf{6}_{EM}$ will dispense one clay target T. Simply by entering the appropriate indicia into a conventional remote control sending unit, the signaling by the remote sending unit will be relayed to a remote receiver (receiving unit) to activate the appropriate solenoid (e.g. $\mathbf{6}_{EM}$ represented as activating $\mathbf{6}S_1$ or $\mathbf{6}S_2$ in FIGS. 6-8) for the proper positioning to dispense the desired number of targets. The particular illustration of FIGS. 6-8 includes a solenoid activated adjustable top solenoid stop $\mathbf{6}S_2$ for dispensing multiple targets T (e.g. two) and a bottom solenoid stop $\mathbf{6}S_1$ for dispensing one target. Adding another solenoid $\mathbf{6}_{EM}$ at the appropriate stopping position would allow three targets T to be dispensed. In a conventional manner solenoids may readily adapted to remotely controlled systems so as to dispense a desired number of shooting targets T or to provide the appropriate positioning of a guide rail 8 to throw one or more stacked targets. The schematic representation of a remotely controlled system of FIG. 17 is typical of such conventional remote controlled systems which may be operationally used to remotely control solenoid activation. Thus, FIG. 17 depicts the application of a conventional remote controlled system to control the adjustment of the guide site 8 as well as the dispensing unit which are referenced in FIG. 17 as guide site solenoid and a dispensing unit solenoid. The remote controlled system includes a conventional AC or DC power source for powering the remote receiver which in turn electronically activates the appropriate solenoid setting for the dispensing and the guiding of the desired number of targets to be thrown. As commonly known, remote controlled systems may operatively include a remote control sending unit electronically wired to the signal receiving unit or a sending unit operatively connected by air wave communication (e.g. radio transmission) to the receiving unit.

Irrespective of whether a remote or manual dispensing system is used, the present target throwing device 1 includes an adjustable dispensing member 6 which may (as depicted) retainingly engage onto the lowest outer rim $R_1$ of the stacked targets T within the target shooting retaining member 3 to stop the contacted target T of the columned targets C from passage therethrough and thereby allow only a dispension of the desired number of targets through dispensing port 6*o*. FIGS. 2-4, 6 and 8 illustrate a positioning of the adjustable stops $\mathbf{6}S_1$ & $\mathbf{6}S_2$ when multiple numbers of shooting targets T are desired to be thrown by the targeting device 1. In contrast, FIGS. 5-7 show the positioning of dispensing stops $\mathbf{6}S_1$ & $\mathbf{6}S_2$, when it is desired to dispense a single target T. If more than two targets T are desired to be dispensed, an additional solenoid stop $\mathbf{6}S_3$ (not shown) or mechanically adjustable stops 6S at the appropriate elevational level may be added to release the desired number of multiple targets T from the stacked column C.

The manually adjustable dispensing member 6 shown in FIGS. 1-5 may include a springed stop 6S equipped with an adjustable support head 6H fitted with a stopping head 6S (e.g. as a rubber stop) adapted to engagingly interface onto a target T immediately above the desired number of targets T of the stacked targets column C to be dispensed onto the throwing arm bed 7B. The phantom lines of FIGS. 4A and 5A depict the dispensed targets T from the stacked target column C. Thus, by appropriately manually adjusting or presetting the dispensing stop 6S to the desired number of targets T to be dispensed by the dispensing member 6, the dispension of the desired target T number may be accomplished. The adjustable dispensing member 6 serves as a stop and thereby allows only the desired number of targets T to be dispensed from the stacked target column C of the targets T.

The adjustable dispensing head 6H may include only one adjustable engaging stop 6S or alternatively may include multiple adjustable engaging stops $\mathbf{6}S_1$, $\mathbf{6}S_2$, etc. such as illustrated by FIGS. 6-8. As depicted by FIGS. 1-5, the manually adjustable shooting target engaging stop 6S may be pivotally mountable onto a spring actioned plunger type shaft 6F locomotived by a rotating cam (9C) which upon cam activation forces the dispensing base mount 6M to slideably move forward along slotted guide 6K to engage the desired target stop 6S against the stacked column of shooting targets C and thereby dispense the desired number of targets T through a dispensing port 6*o* onto a revolving throwing tray bed 7B trailed by throwing arm sidewall 7C.

As may be particularly observed by a comparison of FIG. 4A with FIG. 5A, the adjustable stop 6S is depicted as being pivotally mounted upon a compression spring activated dispensing shaft 6F journaled within sliding base support block 6M which upon appropriate rotational adjustment of shaft 6F allows either one or two targets T to be dispensed by the dispensing unit 6. Simply by pivotally adjusting the dispensing stop 6S to the desired number of shooting targets T to be dispensed thereby, the desired number of shooting targets T may be correspondingly selectively dispensed or presented for engagement by the throwing unit 7. As visualized from FIGS. 3-5, 4A and 5A, this may be accomplished by withdrawing shaft 6F so that adjustment wing guides 6W clear side skirts 6Z margining onto slotted guides 6X which allows, shaft 6F along with winged guides 6W and stop 6S to rotate 180° degrees and thereby mate onto the oppositely positioned slotted guides 6X. This changes stop 6S to a 6S1 or 6S2 position or vice versa. FIGS. 5 and 5A shows the positioning of stop 6S adjusted so as to dispense a single target T while FIGS. 2-4 and 4A depict dispensing two targets T via positioning adjustable stop 6S to a higher elevational positioning on the stacked target column C. As may be further observed particularly from FIGS. 4, 4A, 5 and 5A, compression spring 6C serves to retain the shaft wings 6W within slotted guide 6X provided side skirts 6Z at the correct 180 degree positioning ($6S_1$ or $6S_2$) for dispensing the desired target number. Similarly tension spring 6T retains the shaft head 6H and stop 6S in the non-dispensing and non-stopping position until forced forwardly by drive cam 9C.

The dispensing unit 6 shown in Figures herein converts the dispenser of conventional throwing devices into a multiple dispensing unit 6. Conventional units dispensing utilize a stacked column C of shooting targets T dispensed through a dispensing port 6*o* onto a receiving bed 7B which only allow a single target deposited upon a throwing arm 7 for throwing. In contrast to conventional target throwing devices, the dispensing unit 6 herein includes an adjustable stop 6S adjustable to a desired preset stopping position so as to allow the desired number of shooting targets T to be dispensed from the stacked column C of shooting targets T for engagement onto the throwing unit 7.

Other multiple dispensing units 6 instead of the adjustable rubber faced stop 6S as depicted by FIGS. 1-3, 3A, 4, 4A, 5 and 5A may be employed. This is further illustrated by the solenoid operating stops $6S_1$ & $6S_2$ of FIGS. 6-8, which are suited for remote controlled systems and appropriately positioned for stopping and retaining the stacked column C of shooting targets T while allowing for passage of the desired number of shooting targets T to be dispensed thereby.

Figure 16A:
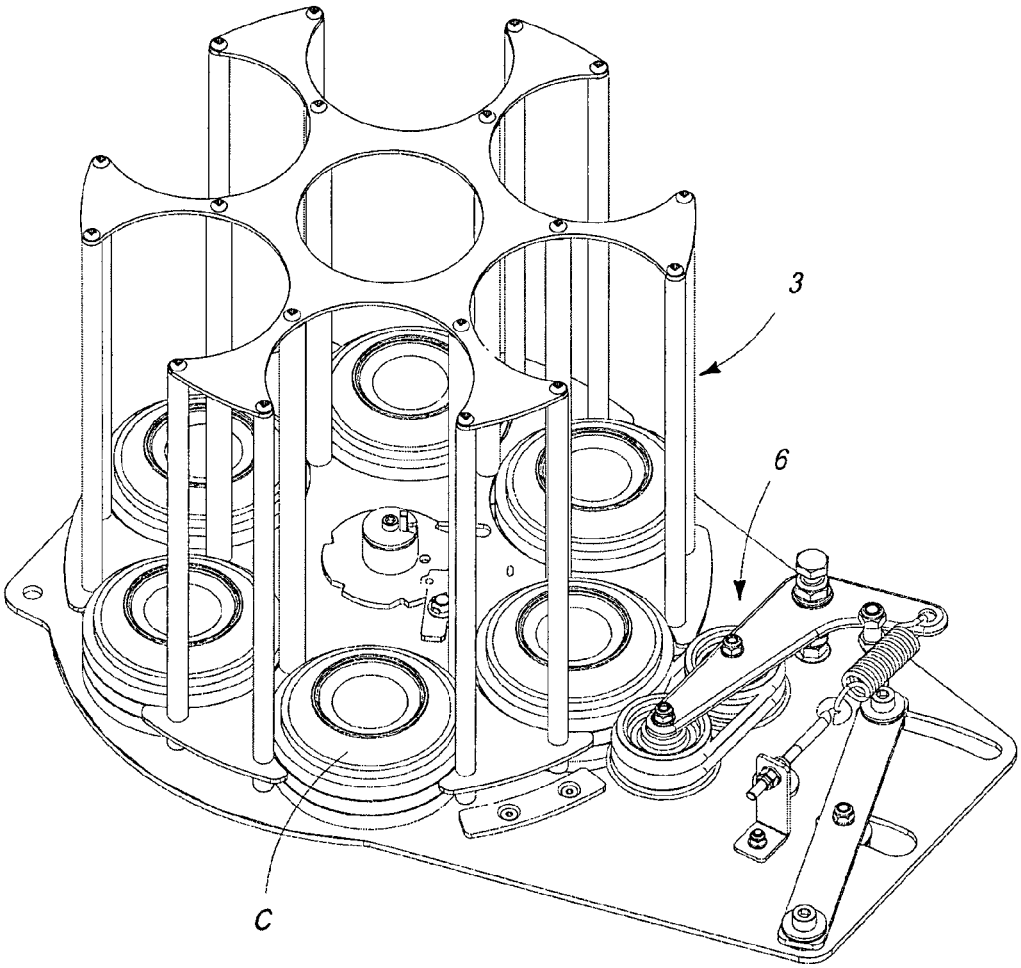
FIG. 16A is a top side view of a target shooting device equipped with six rotating target stacking columns and a dispensing unit adapted to dispense one or more targets.
Figure 16B:
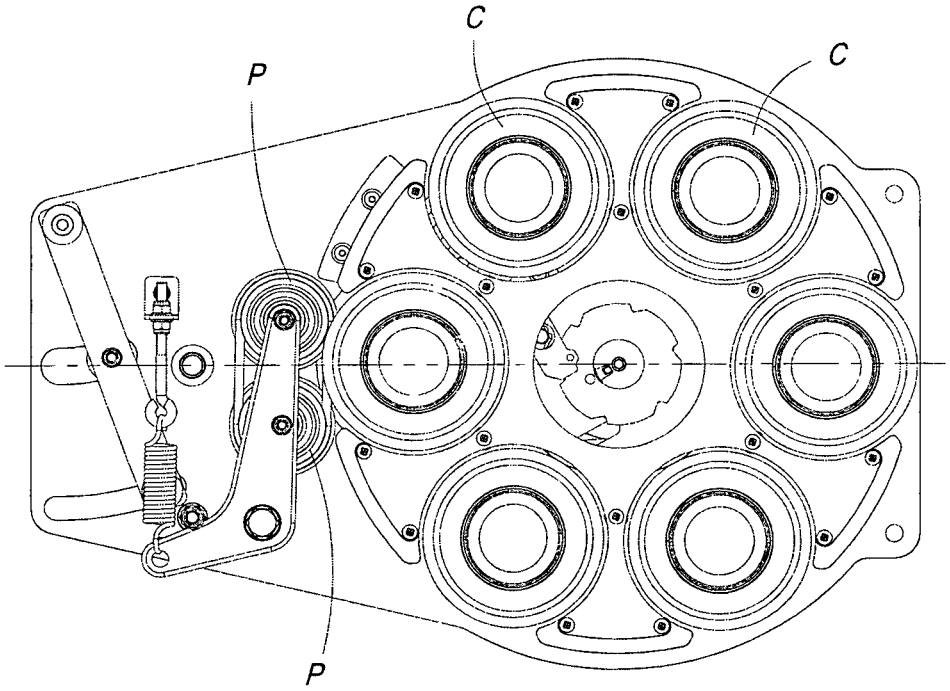
FIG. 16B is a top view of FIG. 16A.
Figure 16C:
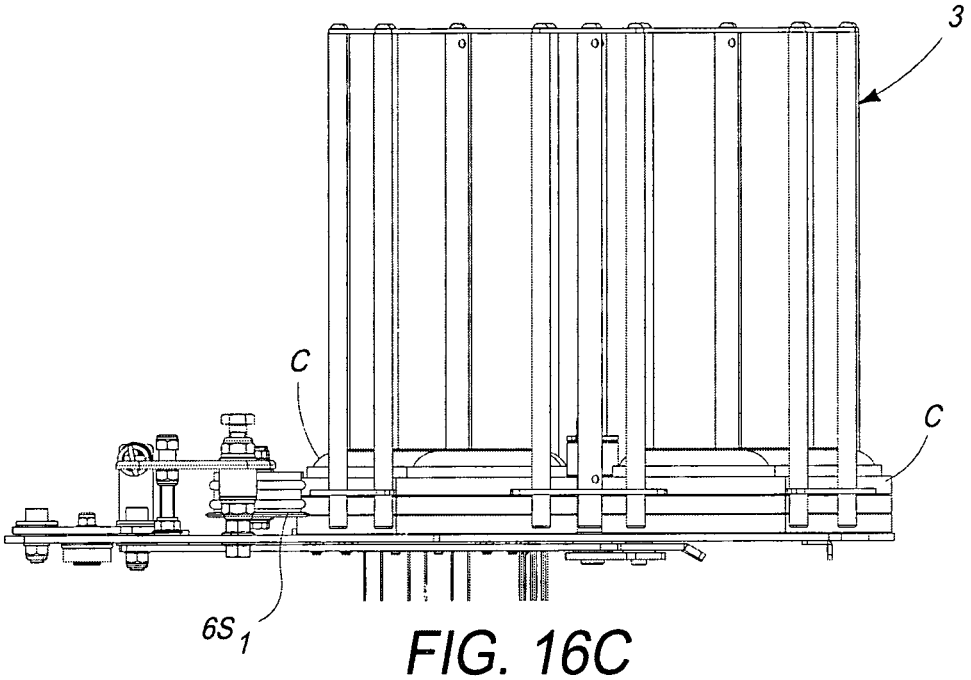
FIG. 16C is a side view of FIG. 16A showing the dispensing unit positioned to dispense one target.
Figure 16D:
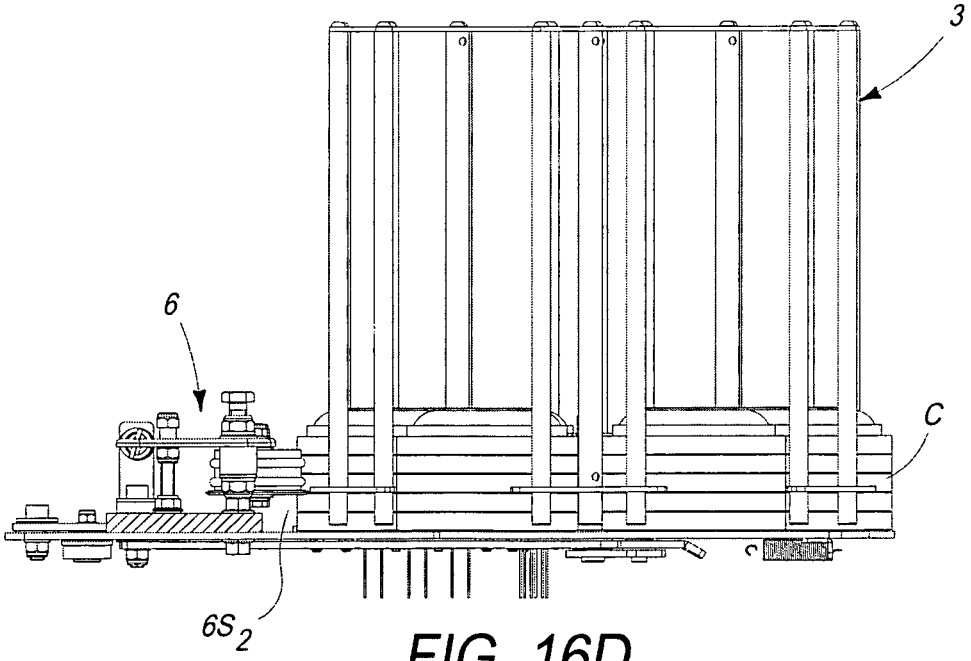
FIG. 16D is the same view as 16C except the dispensing unit is set to dispense two targets.

Other types of stops 6S may also be effectively utilized for this purpose. The multiple stopping embodiments may accordingly be applied to commercially available throwing units equipped with rotating stacked columns as depicted in FIGS. 16A, 16B, 16C and 16D. The target throwing device 1 as depicted by FIG. 16 illustrates an adjustable belt stop 6S which includes a dispensing unit 6 adjustable to dispense a desired number of shooting targets onto a tray 7B upon which the following throwing sidewall 7C throws in a timed sequence the desired number of target T or targets T therefrom. By manually or automatically (e.g. by remote control RC) adjusting the belted stop 6S to an appropriate vertical stopping position so as to stop and dispense the desired number of targets T therefrom, a conventional belted dispenser may be converted to an adjustable dispensing unit 6. FIGS. 16A, 16B, 16C and 16D depict the adaptation of the dispensing unit 6 to a target throwing device 1 equipped with rotating columns feeds holding stacked or columned shooting targets C. The dispensing stop 6S comprises two belts 6S pulleyed about two freewheeling pulleys P which are currently designed to serve as a stop 6S to dispense one a single target T onto a throwing arm bed 7B. FIG. 16D shows the adjustment $6S_2$ made to the stop 6S so to dispense one or two targets $T_1$ & $T_2$ onto the throwing arm bed 7B. The belted stops 6S adjustments as depicted by FIGS. 16A-16D may be manually or electronically adjusted. In a similar manner as shown in FIGS. 6 and 7, solenoids $6_{EM}$ vertically positioned for vertical elevation of stop 6S to the appropriate preset stopping position may be used to dispense the desired number of targets T to the throwing arm 7. If desired, the dispensing unit 6 may be remotely controlled by conventional remote control systems RC. In the depiction of FIGS. 16A-D a remotely controlled solenoid $6_{EM}$ may also be used to provide the necessary vertical preset movement to stop the columned targets C at the desired dispensing stop.

It is not only necessary to present two or more shooting targets T to throwing unit 7 (e.g. arm) but it is also essential to modify the throwing unit 7 to be capable of accommodating multiple shooting targets T thrown in an acceptable flight pattern. This necessitates sufficient clearance between the dispensing unit 6 and the throwing arm bed 7B so as to permit multiple targets T to be carried and thrown by the throwing unit 7. It is also necessary for the thrown targets T to undergo the appropriate target guiding and operational orientation so that the targets T are placed in an acceptable flight pattern for target shooting. These unique embodiments require a means of effectively delivering a desired number of shooting targets T to the throwing unit 7 while also changing the throwing unit 7 to guidingly accommodate and orient the launching of one or more targets T in an acceptable flight pattern for target shooting.

Each of the depicted shooting targets (e.g. such as $T_1$ & $T_2$) are characteristically equipped with what may be referred to as a lower target rim 1R and a second rim 2R (with a plateaued rim region identified as $1R_1$ & $1R_2$) bridging therebetween. These target features in association with the accommodating guide rail 8 positioning effectively and cooperatively provide the proper positioning and flight inertia or spin upon the target $T_1$ or targets $T_1$ & $T_2$ presented for targeting. The first rim 1R height of most commercially available targets is typically of a standardized height irrespective of the shooting targets diameter. Likewise the width of plateau $1R_1$ or $1R_2$ is generally of a standard width for the various target brands commercially available which generally means the distance between the first rim 1R and the second rim 2R typically remains constant. The illustrated shooting targets $T_1$ & $T_2$ are individually shown as having two concentric rims 1R & 2R and an upside down dinner plate or domed surface which permits each target T to be easily stacked in a columned stacked form C for dispensing by dispensing unit 6. Typically most targets are commercially provided with at least two concentric rims 1R & 2R with a bridging plateau $1R_1$ therebetween. For a typical target T, appropriate adjustments may be made to accommodate the targets T.

Similar to the adjustable dispensing unit 6, the throwing unit 7 necessitates multiple guide sites (generally prefixed 8) upon the throwing arm 7 in order to present either single or multiple targets T (e.g. in a proper operational rotational form) for throwing in a proper flight pattern by the throwing arm 7. This requires either multiple guide rails 8 preset at an appropriate guide rail 8 positioning or a guide rail 8 adjustable to accommodate the presented targets T. The adjustable or multiple guide rails (generally prefixed by 8) utilize the concentric rimmed structure of the shooting targets T as a means for stabilizing, orienting and creating a desired rotational spin for the multiple or single targets T thrown by the device 1. The throwing unit 7 may be equipped with multiple shooting target retaining guides so as to retainingly engage the number of shooting targets T dispensed by the adjustable dispensing member 6. The multiple arm shooting target engaging guides 8 may be appropriately positioned or emplaced upon the throwing arm 7 in a staggered preset position so as to accommodate one or more targets T. This may be accomplished by modifying the shooting arm 7 so as to include a plurality of offset throwing unit target guides 8 extending longitudinally along the throwing arm 7 major axis which respectively retainingly engages onto the number of shooting targets T to be presented for throwing by the throwing arm 7. Similarly the adjustable rail 8 must be preset to guide sites so as to accommodate the desired number of targets T presented for throwing.

Figure 11:
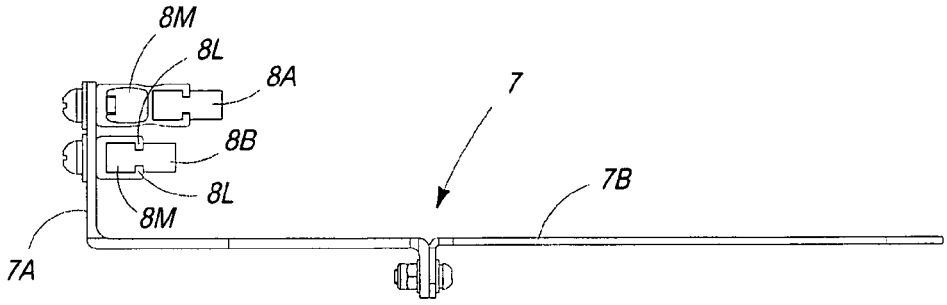
FIG. 11 is an end view of the target throwing arm shown in FIG. 9.
Figure 12:
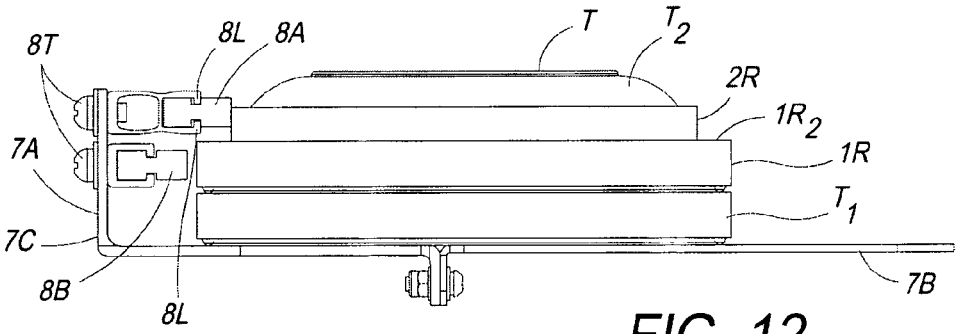
FIG. 12 is an end view of FIG. 11 depicting the guide rail alignment of two throwing targets positioned upon the throwing arm to be thrown therefrom.
Figure 13:
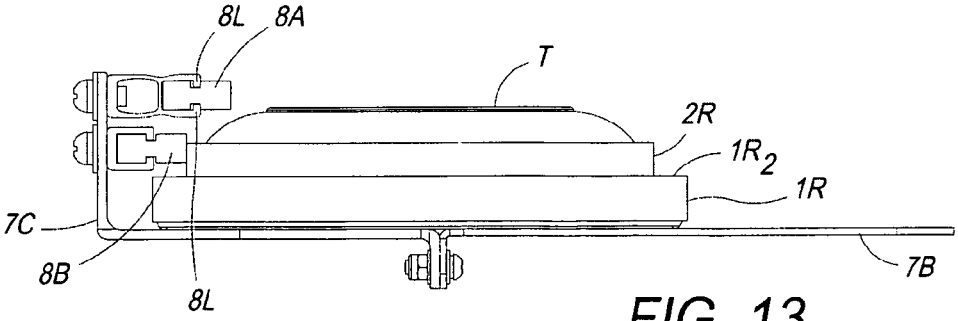
FIG. 13 depicts an end view of FIG. 11 showing the guide rail alignment with one throwing target tracking upon the throwing arm.

When it is desired to throw one or two targets T, the multiple guide sites 8 may be provided in any multiple site form such as two rubber guide rails 8A & 8B adapted to frictionally engage and guide either one or two targets T for throwing as may be particularly observed from FIGS. 11-13. This multiple guide rail 8 feature necessitates guide rails 8A & 8B to be arranged upon the throwing unit 7 with the uppermost guide rail 8A projecting slightly more outwardly than a lower receding guide rail 8B as shown by the throwing arm 7 end views of FIGS. 11-13. The same basic arrangement applies when only a single target T is presented for throwing. This arrangement allows the upper guide rail 8A to be positioned in a guiding position onto the uppermost presented target slightly above the uppermost surface of the base rim 1R while tangentially engaging onto the outer rim circumference of rim 2R as may be observed from FIGS. 12 and 13. Accordingly when only one target T is presented for throwing, the receding lower guide rail 8B serves as a lipped guide 8 bridging between the contoured uppermost surface $\mathbf{1}R_1$ of the first rim 1R and as a tangential contact upon the outermost second rim surface 2R as depicted in FIG. 13. If more than two targets T are presented, an additional more elevated projecting rail (not shown) positioned to frictionally engage the rim 2R of the third and uppermost target and lipping over rim 1R may likewise be incorporated into the throwing unit 7.

By placing at least two throwing arm target guides 8A & 8B in a stacked relationship (e.g. a receding parallel relationship) each of the target guides 8A & 8B will appropriately serve to matingly guide onto the uppermost corresponding rim 2R of a single target T or of multiple targets T if more than one stacked shooting targets T are presented to the throwing unit 7. This arrangement provides the appropriate targeting spin upon the presented target T or targets T as they centrifugally progress along the throwing arm 7 onto a throwing position. This will correspondingly create the proper momentum for each of the shooting targets T by imparting the appropriate spin as essentially required when single or multiple targets T are launched through the atmosphere to an appropriate position for targeting.

The throwing unit 7 may accordingly be appropriately fitted or equipped with a sufficient number of positional guides 8 or guide positioning so as to positionally maintain the predetermined number of shooting targets T presented thereto in an appropriate operational condition or momentum so as to create a desirable operational flight pattern for target shooting. With particular reference to FIGS. 10-13, the depicted throwing unit 7 is equipped with two guides 8A & 8B in the form of rubber rails 8A & 8B. The depicted two rails 8A & 8B are positioned along the longitudinal axis of the throwing unit 7 shown as a throwing arm 7 in a parallel and vertically staggered relationship. With further reference to FIGS. 10-13, the bottom rail 8B retainingly maintains a single target T in flat position by its positioning above the top side plateau $\mathbf{1}R_1$ or $\mathbf{1}R_2$ or upper surface of rim 1R while bridging onto the outermost circumferential surface of the second rim 2R when only one target T is presented for throwing. Similarly, the upper rail 8A retainingly maintains the rimmed surface bridging the upper target rim 1R in a horizontal position within the throwing bed 7B while providing a spinning motion to the circumferential surface of target rim 2R of the upper shooting target T when two shooting targets T are presented for throwing to the throwing unit 7. If three shooting targets T are present (as may be perceived by FIG. 15) the upper guide rail 8A may be accordingly adjusted upwardly or another additional rail adapted to correspondingly mate with rims 1R & 2R of the upper shooting target T stacked thereupon. The projecting tip of the contacting rail 8 provides spin while the lower horizontal surface of rail 8 stabilizes and helps to retain the target $T_1$ or targets $T_1$, $T_2$, etc. upon throwing bed 7B. The same operational mode will apply when throwing three targets.

Figure 15:
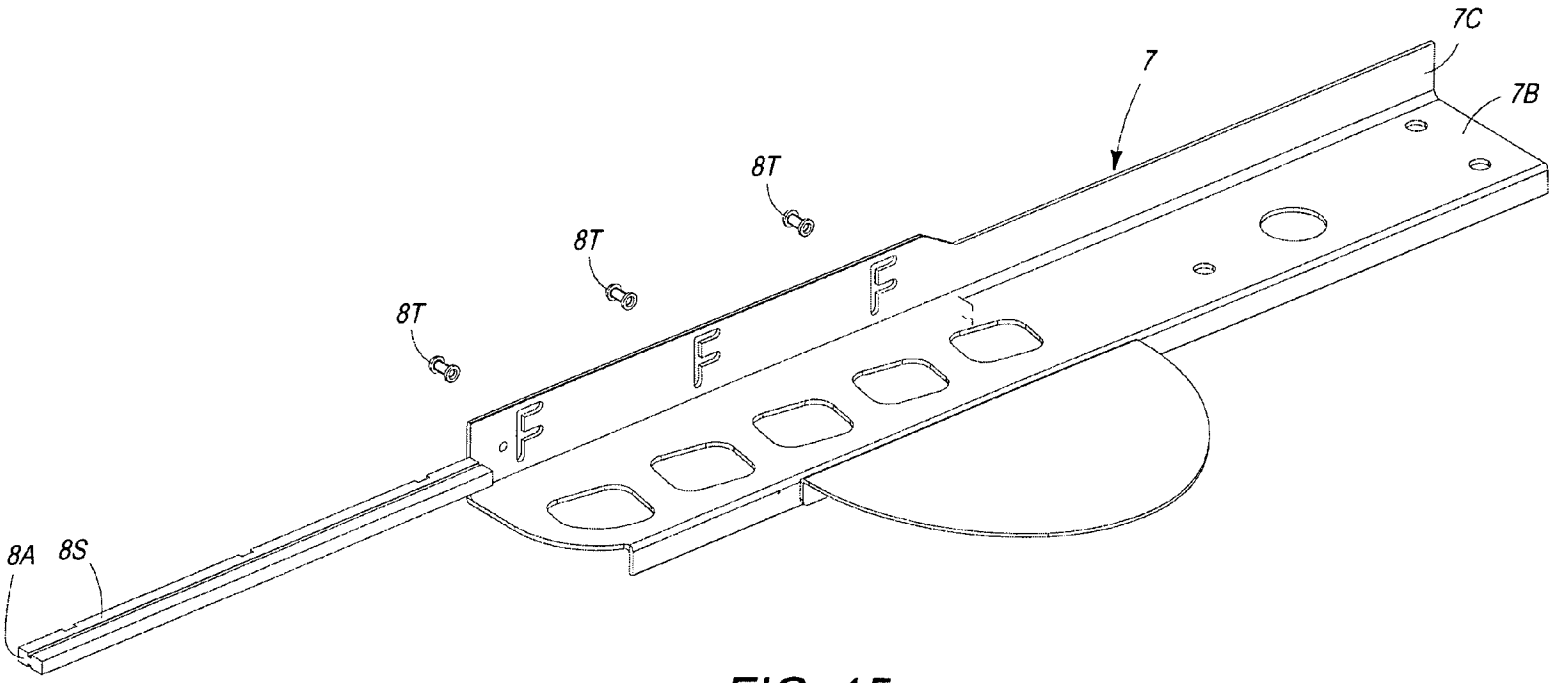
FIG. 15 is a frontal, isometric, dissembled partial view of the throwing arm equipped with a single adjustable guide rail.

As may be observed from the FIG. 12, the uppermost throwing arm rail 8A is placed at an off-set forwardly position so that when two stacked targets $T_1$ & $T_2$ are presented to the throwing arm 7, the upper rail 8A engages onto the vertical rim surface of rim 2R while rail 8B is sufficiently receded therefrom so as to provide clearance thereof from rim 1R of the lower target T. If three or more targets T are presented (shown) then the uppermost guide rail (e.g. such as an unshown 8C) or an adjustable rail 8 as shown in FIG. 15 would likewise be positioned with a leading edge engaging onto the vertical wall of the second rim 2R. If three or more rails 8, the lower rails (8A, 8B, etc.) would be set back sufficient to clear the bedded targets T. The same principles also generally apply when smaller diametered shooting targets are presented to the shooting arm 7.

As may be further observed from FIGS. 5 and 13 when only one target T, is presented to the throwing arm 7, the lower guide rail 8B is positioned so as to interfacially contact upon the vertical rim surface of 2R while guide rail 8A is positioned in a recessed position upon the throwing arm 7 so as to clear target T, and thereby allow the vertical surface of rim 2R to seat onto guide rail 8B and thereby provide the appropriate inertia for effective targeting flight. It may also be seen that guide rails 8A & 8B may be set or positioned at a relatively close tolerance to the plateaued surface (e.g. $\mathbf{1}R_1$ or $\mathbf{1}R_2$) of rim 1R to entrain the target or targets ($T_1$ & $T_2$) in a substantially flat lying position upon the throwing bed 7B of throwing arm 7.

The multiple guide sites 8 serve a useful purpose in operationally maintaining multiple shooting targets in an operationally position for throwing the multiple shooting targets T with the shooting unit 7. In a typical operational use of the target throwing device 1 with multiple shooting targets T (as depicted in FIGS. 4A and 12), the shooting targets T will tend to retainingly and rotationally roll outwardly along the rail guide (e.g. 8A or 8B) until the targets T reach a throwing position. Similar to discuss throwing, the shooting targets T generally necessitate an appropriate spinning action so as to create the desired flight pattern and targeting position for shooting. Rail guides 8A & 8B are highly effective in creating an appropriate flight pattern for either a single or multiple target throwing.

The multiple positioned guides 8 used in positionally maintaining the shooting targets T in the appropriate condition for throwing the shooting targets in an acceptable flight pattern for target shooting may be provided in the form of multiple rubberized rails 8A & 8B (or any similar material so as to create the desired friction, roll, and spin) aligned in a vertically staggered and parallel arrangement. In order to effectively serve as a multiple positional guide or guides 8, the guide 8 must necessarily be able to facilitate and maintain the multiple stacking of targets T in substantially flat position upon the throwing arm bed 7B as the targets T traverse along the throwing unit or arm 7.

In order to provide an acceptable target shooting flight an appropriate rotational spin upon the cylindrical targets T must be applied. As the targets T rotate after entry upon the throwing arm bed 7B and their throwing discharge at the throwing end of the throwing arm 7 an appropriate rotational spin is applied. The appropriate spin may be effectively provided by providing any material of a relatively high coefficient of friction which engagingly interfaces onto the shoot target rim (e.g. 2R) to create the necessary spin as the target T centrifugally rolls along the throwing arm surface. Elastomeric materials such as the natural and synthetic rubbers are particularly useful for this purpose. As may be observed by FIGS. 10-12 the contracting rubber guides 8A & 8B may be provided in a replaceable form. This may be, for example, accomplished by providing a rubber rail of a rectangular cross-sectional shape equipped with upper and lower guide female slots 8S longitudinally bisecting the upper and lower rail surfaces mountable upon support brackets 8M equipped with converging male flanges or lips 8F mating onto the female slots or grooves 8S which permits anchoring and housing of the reward portion of rail guide 8A or 8B within support bracket 8M. This feature allows for replacement of worn or damaged rail guides 8A or 8B. As may be further observed from FIGS. 10-13, each of the guide rails 8A or 8B is equipped with a blade mountable retaining support frame 8F having a pair of converging flanged lips 8L. With further reference to FIGS. 12 and 13 the rubber rail sections 8A or 8B also each contain a longitudinal lengthwise extending groove 8G adaptable to slideably engage within flanged lips 8L to retainly house the rearward portion of blades 8A & 8B. The rearward end of support frame 8F is equipped with anchoring set screw receiving nuts 8N for mounting the frame 8F to the sidewall 7C of throwing arm 7. Receiving set screws 8T are illustratively used to fasten rail 8 to arm side throwing arm rail 7C.

Similar effects may be accomplished by an adjustable single guide 8 (e.g. see FIG. 15) which may be appropriately horizontally adjusted so as to accommodate the number of shooting targets T presented to the throwing unit 7 for throwing. Similar to the multiple rails 8A & 8B, an adjustable rail 8 may likewise operatively engage onto rim circumferences 2R of the uppermost presented target T to create proper momentum while still retaining the stabilizing guiding influence upon rim 1R. For example, the multiple rail system 8A & 8B as depicted in FIGS. 10-13 may consist of an adjustable single bar 8 which may be preset manually or automatically longitudinally at an upwardly or downwardly position along the throwing unit 7 so as to adjustably engage and retain the number of shooting targets T presented for throwing to the throwing unit 7. Other variations or means of presenting and positioning multiple shooting targets T to the throwing unit 7 and then throwing the shooting targets T in a desired flight pattern for target shooting may be similarly adapted to the device 1 of the present invention.

As illustrated by FIG. 15, the multiple guide sites 8 may be provided as an adjustable guide 8 adapted for adjustment to the desired number of targets T to be presented for throwing by the throwing unit 7. FIG. 15 depicts a manually adjustable guide rail mountable to the vertical arm side rail 7C. Side rail 7C is equipped with two lateral vertically positioned slots $7S_1$ & $7S_2$ each equipped with three horizontally extending latching notches $7L_1$, $7L_2$ & $7L_3$ which correspond for mating engagement onto the desired number of targets T presented to the throwing arm 7 for throwing. By positioning the rail 8 in the appropriate notch (e.g. $7L_1$, $7L_2$ or $7L_3$) to the corresponding number of targets to be dispensed onto the throwing arm bed 7B, the correct positioning for throwing targets may be achieved. Set screws 8T may then be tightened accordingly to mount rail 8 at the desired throwing position upon the throwing arm (rail 7C).

The manually adjustable single guide 8 of FIG. 15 may be of the same construction as the rails 8A & 8B shown in FIG. 10-13 adaptable for adjustment to match the number and type of targets T to be thrown by the target throwing device 1. The vertically side rail 7C of disposed throwing arm 7 is provided with a pair of vertical and laterally disposed slots $7S_1$ & $7S_2$ which may correspondly mate onto the anchored bolt receiving nuts for mounting frame 8F of the adjustable guide rails 8 to throwing arm 7. The slots $7S_1$ & $7S_2$ may appropriately bear an indicia to a desired predetermined setting for the desired number of targets T to be thrown. Notches $7N_1$, $7N_2$, & $7N_3$ are positioned so as to set the guide rail 8 at a position to match the number of targets T presented to the throwing unit 7 for throwing. Because the adjustable guide rail 8 may be adjusted to clear the first rim 1R and contact the periphery surface of the second rim 2R in order to provide the necessary spin, the need for more than one rail 8 is avoided. Simply by sliding the guide rail 8 up or down guide along guide slots $8S_1$ & $8S_2$ to the desired notch ($8N_1$, $8N_2$, & $8N_3$) followed by sliding the guide rail 8 sideway into the desired notch (e.g. $7N_1$, $7N_2$, or $7N_3$), the desired guide rail 8 positioning is achieved. Tightening the depicted set screws $8T_1$ & $8T_2$ onto the guide rail nuts 8N of rail frame support 8M secures guide rail 8 to the throwing arm 7 within the appropriate notches (e.g. $N_1$, $N_2$, or $N_3$) Accordingly, the target throwing device operator may place the desired number of clay targets T upon the throwing deck and accordingly preset the adjustable guide 8 to desired predetermined target throwing guide position so as to throw the desired number of clay targets T therefrom.

The adjustable guide rail 8 depicted in FIG. 15 may utilize different types of mechanisms to mechanically adjust the guide rail 8 to the desired preset rail 8 positioning such as electromagnetic system (e.g. solenoids), calibrated elevators or worm screw adjusters, off set cam or lever adjusters as well as any other mechanical means of manually or electronically adjusting and setting the guide rail 8 at the desired positioning. If desired the guide rail 8 adjustment may be automated for remote control. The automated form of the adjustable guide rail 8 may embody various different automated techniques permitting for the automated adjustment thereof. For example electromagnetic adjusters (e.g. solenoids), ratching, cams, worm screws, etc. as well as electronic driven and remotely controlled remote systems by conventional means may be applied to an automated and remotely controlled adjustable guide rail 8 herein. The remotely controlled solenoid dispensing stops $6S_1$ & $6S_2$ as depicted in FIGS. 6 and 7 may be modified and applied to these adjustable guide 8 embodiments in FIG. 15.

Figure 2:
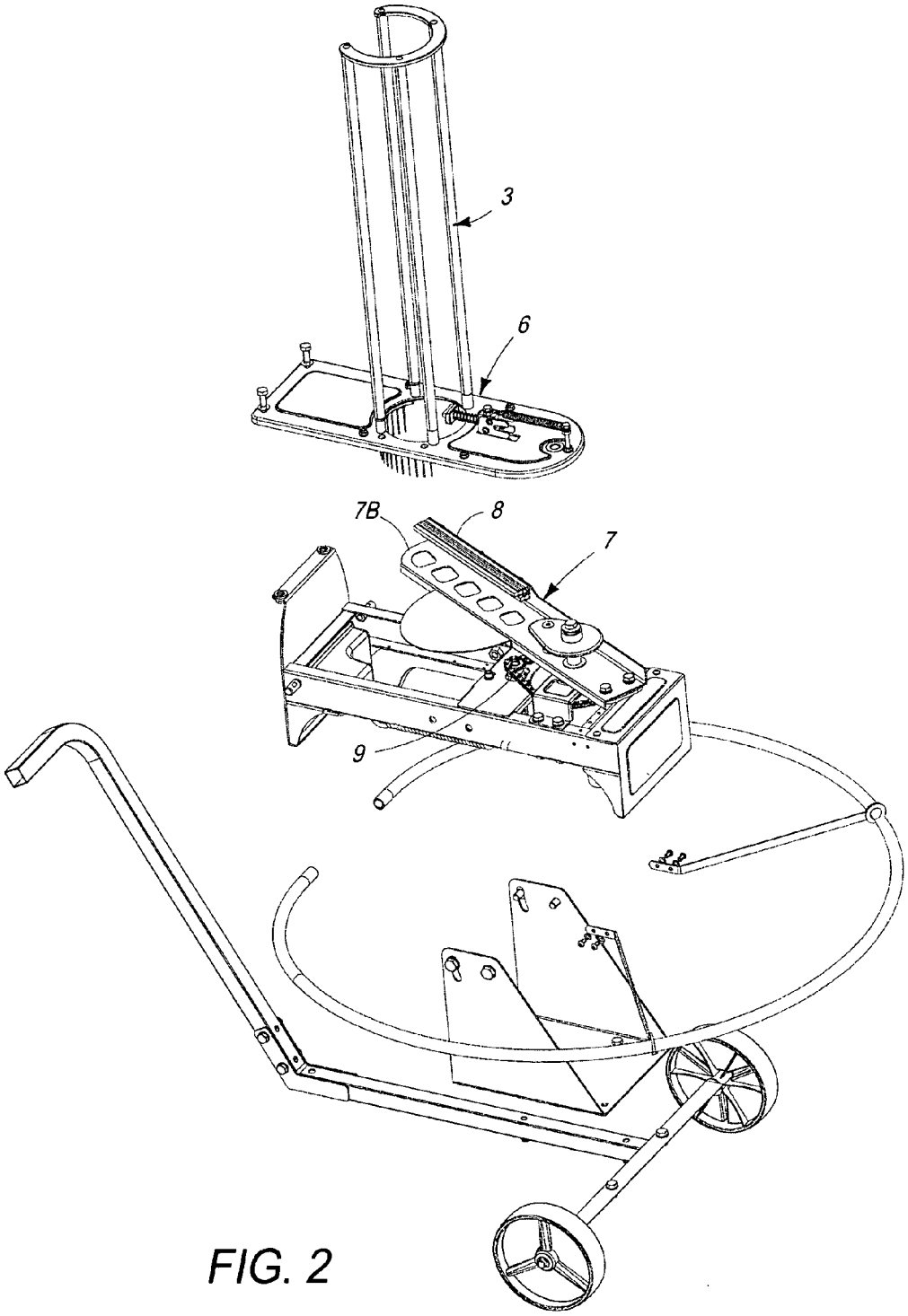
FIG. 2 is a disassembled isometric view depicting various components of the device shown in FIG. 1.
Figure 3:
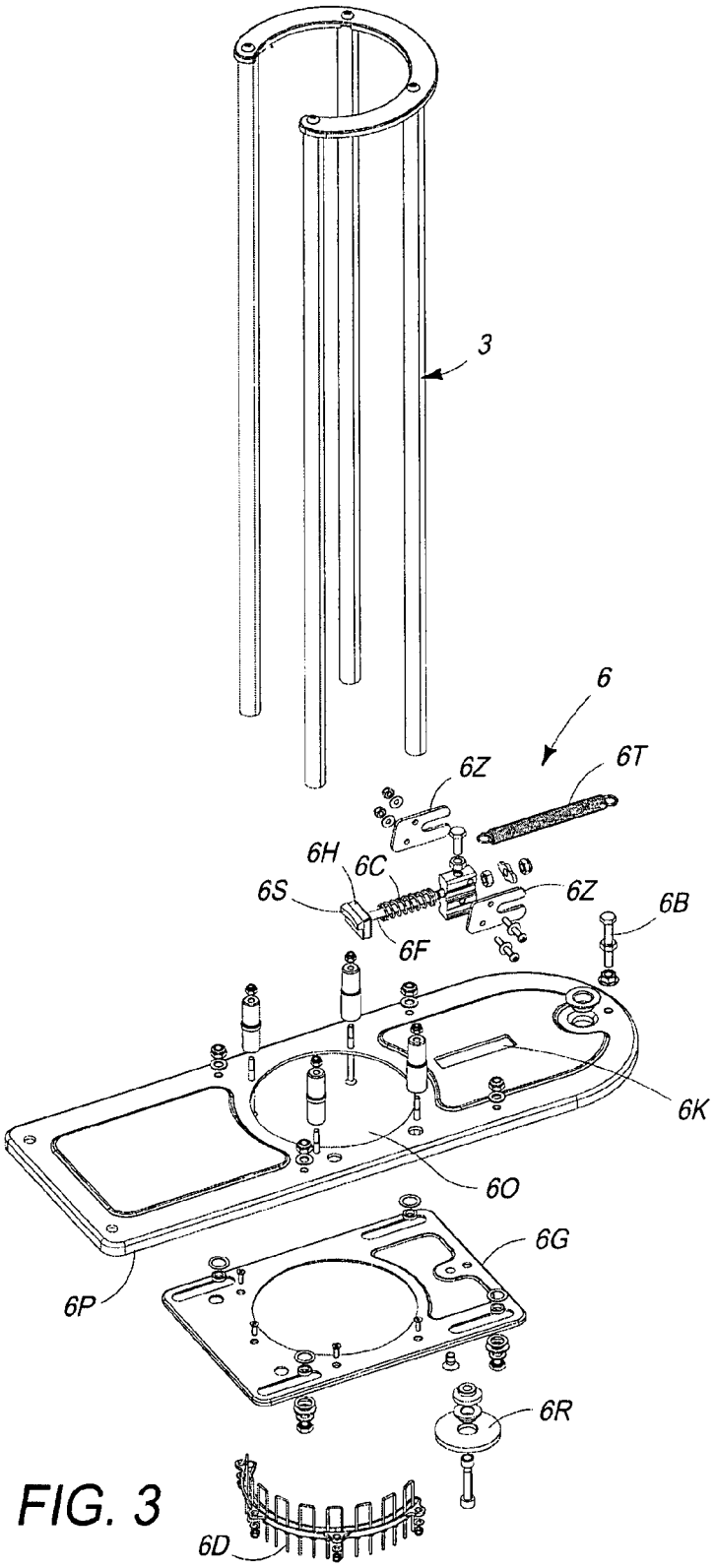
FIG. 3 is a disassembled isometric view of the target retaining member and the target dispensing unit shown in FIGS. 1 and 2.
Figure 3A:
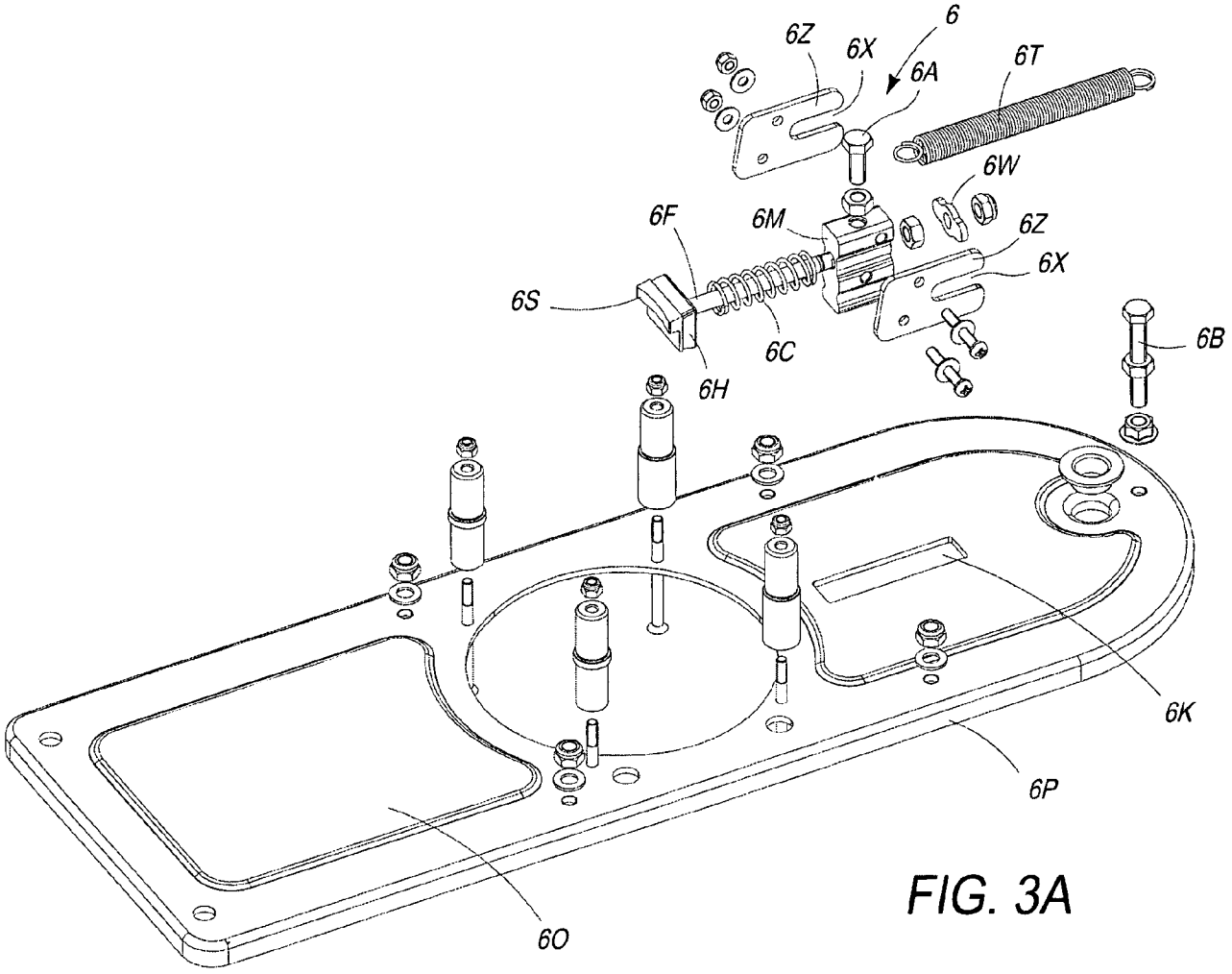
FIG. 3A is an enlarged view of the dispensing unit shown in FIG. 3.
Figure 14:
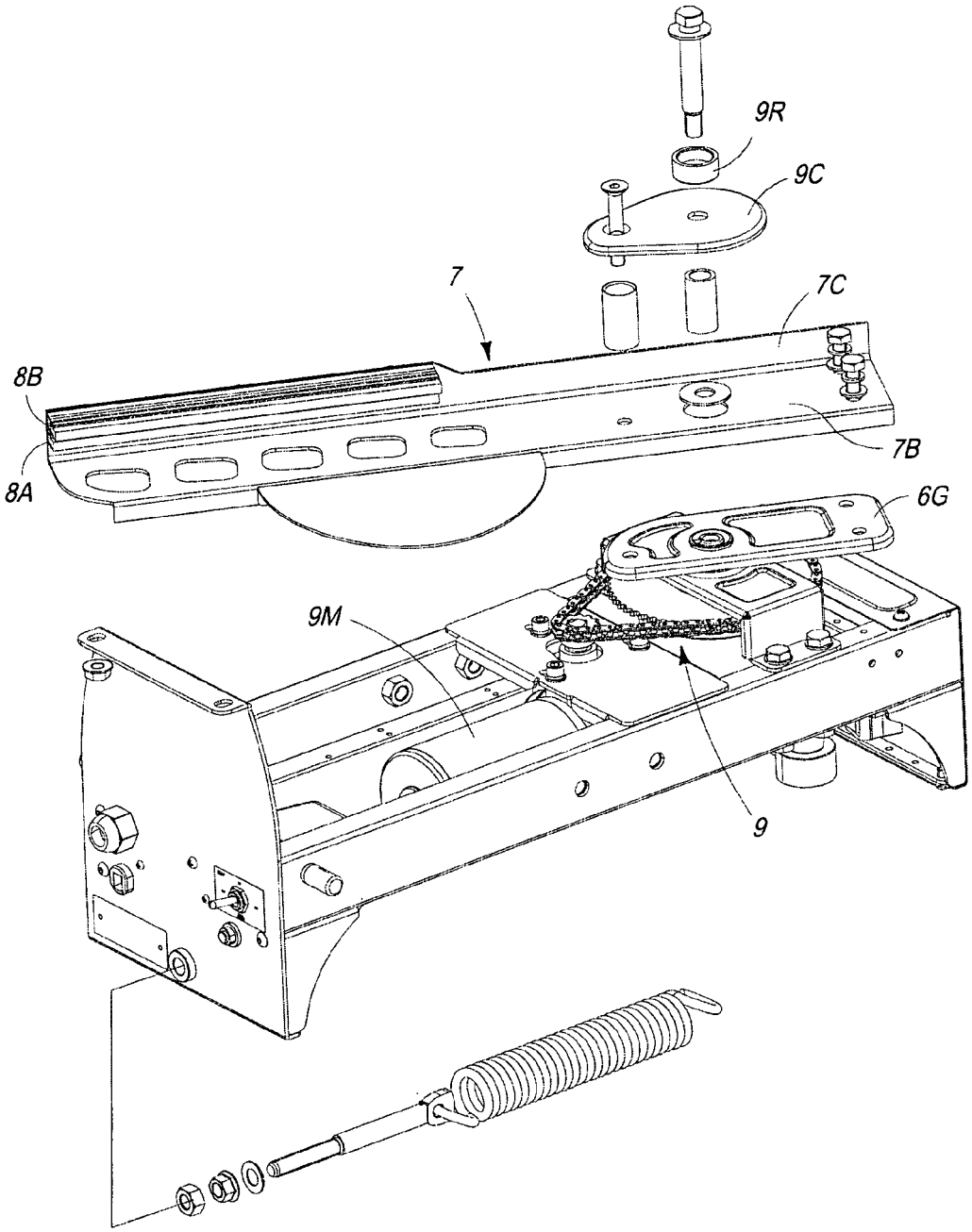
FIG. 14 is partially unassembled isometric top view of the target throwing unit and the propelling unit shown in FIGS. 1 and 2.

The propelling member or unit 9 provides the driving force and mechanical means for driving the throwing arm 7 and the dispensing unit 6. This is conveniently provided by a throwing arm tension spring motor driven cam 9C and electric motor 9M, with chain driven gears and such other conventional drive components for propelling the throwing arm 7 and dispensing unit 6 as illustrated in FIGS. 1-2 and 14.

The target throwing device 1 of this invention provides a host of advantages and benefits over past throwing devices. The present target throwing device 1 affords a unique capacity to simultaneously throw multiple shooting targets T with a single device 1 equipped with a single throwing arm unit 7 and a single adjustable dispensing unit 6. The component parts and how the component parts of device 1 cooperatively function to produce the simultaneous throwing of two or more shooting targets using a single device dispensing member 6 and throwing unit 7 substantially reduces both the manufacturing and maintenance costs. The device 1 may be provided in a light compact form for easy stowing without necessitating duplicate or costly components (e.g. two throwing arms). These features coupled with the unexpected efficacy and unexpected benefits uniquely distinguish as provided thereby target throwing device 1 of this invention from prior target throwing devices.

Example 1

A Champion brand 40909 EASYBIRD Auto-Feed target throwing device as commercially available at numerous hunting and sporting goods retail outlets nationwide, manufactured by Prima Precision Metals LTD, Si Jiu Town, Taishan City, Guangdong, China, currently sold and distributed by Federal Cartridge, a division of Alliant Techsystems, ATK, was altered to provide the capability of presenting one or more targets T to the throwing arm 7 and also equipped with multiple guides 8 (8A & 8B) to permit the simultaneous throwing of one or more targets T in a highly effective target shooting pattern. These changes necessitated the heightening of the clearance space between the port support plate 6P and the throwing arm bed 7B to accommodate two or more stacked shooting targets T traversing therebetween as depicted by FIG. 4A.

FIGS. 5, 5A and 7 depict the adjustable target dispensing unit 6 adjusted so as to present only one target to the throwing unit 7 while FIGS. 4, 4A and 6 depict an adjustment of the dispensing unit 6 so as to present two stacked targets T to the throwing unit 7. With particular reference to FIGS. 4A, 5A and 7, the dispensing unit 6 includes a dispensing stop (prefixed by 6) which depending upon its positioning will present either one or two targets to the throwing unit 7.

The depicted dispensing unit 6 comprises a slideable dispensing gate 6G mounted at the entrance of dispensing port 6*o* and operational beneath the target stacking column C of the throwing device 1. As customary the dispensing gate 6G slidingly opens and shuts the dispensing port 6*o* in response to an oval shaped cam 9C (driven by electric motor 8M) which travels about a circular disc 8R as conventionally provided by the brand 40909 throwing device. The positioning of the throwing arm bed 7B, the opening and closing of dispensing port 6*o* in combination with the cam operated slideably mounted dispensing gate 6G are conventionally synchronized (as provided by the brand 40909 throwing device) so that when the throwing arm receiving bed 7B becomes directly positioned beneath dispensing port 6*o*, the dispensing gate 6G will then be placed in an open position to allow the desired number of targets T to presented to the throwing arm 7.

With particular reference to FIGS. 4A and 5A, a tension spring 6T secured at one end to anchoring post 6B and anchored at an opposite end to a slideably engaging post mount 6A carried upon slideably mounted support base 6M. Tension spring 6T serves to retract or pull the adjustable dispensing unit 6 away from the port outlet 6*o* until the synchronized oval shaped cam 9C forces the adjustable stop 6S to a stopping position so as to allow only the desired number of targets T to pass through port 6*o* onto the throwing arm bed 7B while serving as a stop to retain the remaining targets T stacked above the desired targets T within the stacked column C of targets T. Dispensing gate 6G is synchronized to open for target dispensing and becomes partially withdrawn so as to seal port 6*o* while the oval shaped cam 9C operationally engage onto circular disc 8R retracts the dispensing stop 6S to a retracted position. The propelling unit 9 is driven by electric motor 9M which drives the depicted chain driven gears.

The base support 6M for stop 6S slideably engages within slotted support guide 6X. It may be particularly observed from FIGS. 3, 3A, 4, 4A, 5 and 5A that the slideable mounted base 6M includes oppositely side laterally positioned skirts 6Z each fitted with a slotted guides 6X which serves to maintain stop 6S in an appropriate dispensing position for dispensing the desired number of targets T to the throwing arm 7.

The adjustable stop 6S includes a metal support head 6H upon which rubber stop 6S is appropriately mounted as the stop 6S for the dispensing of one or two targets. A steel shaft 6F is affixed by mounted at one end to metal support head 6H. The opposite end of shaft 6F slideably engages onto base support 6M with compression spring 6C serving to bias outwardly stop 6S. Steel shaft 6F is terminated at the distal end by a pair of outwardly extending winged guides 6W which adjustable seat within the grooved slots 6X of side skirts 6Z as the oval shaped cam 9C propels the adjustable stop 6S in a sequential or reciprocating forward and backward movement.

Pinned between metal support head 6H and winged guides 6W is compression spring 6C which contacts and expands in response to movement of the conventional drive cam 9C. As cam 9C operationally moves, dispensing base 6M will move inwardly and outwardly along slotted support guide 6X so as to compressively position stop 6S in a stopping or non-stopping position. As will be observed, rubber stop 6S is positioned in a vertically off-set position so that when it is positioned as shown in FIGS. 5 and 5A, it will allow only one target T to be dispensed. However, when shaft 6F and winged guides 6W are rotated 180 degrees so as to be positioned in the opposite slotted guide 6X, the rubber stop 6S (as shown in FIGS. 4 and 4A) then allows two targets T to drop onto the throwing arm bed 7B.

The adjustment of the dispensing head 6H may be accomplished by simply withdrawing guide wings 6W to a backward position so as to clear the slotted guides 6X and then pivotally rotating the winged guides 6W 180 degrees so as to mate onto the oppositely positioned guide slots 6X and thereby reposition the stop 6S to a desired positioning for dispensing the desired number of targets onto the throwing unit 7.

Another important aspect of enabling the present target throwing device 1 to throw a single or multiple target T involves how the targets T are actually presented and allowed to generate the necessary momentum along the throwing unit 7 or arm 7 so that the target or targets T upon throwing will effectively undertake the necessary flight pattern for target shooting. This may be accomplished by providing a sufficient number of positional guide sites so as to guidingly align and maintain the targets in proper form (e.g. momentum and alignment) for throwing.

An effective manner of accomplishing these objectives is illustrated by the depictions of FIGS. 9-13 which illustrate a throwing arm 7 properly equipped to simultaneously thrown two targets T in a highly acceptable flight pattern for target shooting.

As may be observed, the throwing arm 7 is equipped with two guide rails 8A & 8B in which the lower recessed rail 8B serves to guide a single presented target T whereas the upper protruding rail 8A serves as an operational guide when two stacked targets T are presented for throwing.

With respect to the projecting top guide rail 8A, it is positioned in close proximity to uppermost rim surface of rim 1R or bridging between plateau rim $\mathbf{1}R_1$ and the outer most rimmed surface of the upper target T so as to permit the two presented targets to slide freely (but retainingly with frictional contact) beneath guide 8A and along guide 8B. When a single target T is presented as depicted in FIGS. 5, 5A and 13, the receding lower guide rail 8B will be juxtapositioned onto the uppermost surface region $\mathbf{1}R_2$ of the bottom rim 1R and the outermost surface of second rim 2R of the target T.

Except for the necessary changes required to present or dispense the desired number of targets T by the adjustable dispensing bed 6 to the throwing bed 7B and those made to the throwing unit 7 by the positional guides 8, the remaining operational components of the brand 40909 may be applied to use with the throwing device 1 of this invention.

Although there may exist a minor discrepancy in the height of each rung or rim for targets T of a different diameter, this minor difference or discrepancy will not generally create a problem in guiding and maintaining a single or multiple targets in proper form for effective target shooting. Commercially available targets T are generally standardized in rim configuration.

1 Target Throwing Device
T Shooting Target
3 Target Retaining Member
6 Dispensing Unit
7 Throwing Unit
8 Positional guides
9 Propelling member
6H Adjustable head
C Stacked column
3A, 3B, 3C & 3D Stacking posts
Ro Lowest outer rim
6P Port outlet
7B Throwing arm bed
8A & 8B Guide rails
2R Second rim tier
3RC Third rim circumference
1UR First rim upper rail
2Ro Outer most second rim surface
1R & 2R Retaining rims
8B Bottom rail
8A Upper rail
6*o* Dispensing port
6G Dispensing gate
6T Dispensing retaining spring
6B Anchoring post
6A Base mount spring post
6X Slotted guides
6S Adjustable rubber stop
6F Steel shaft
6W Winged guides
6Z Guide skirts
6T Tension spring
6M Dispensing base
6PS Plate slot
6D Dispensing guides
$\mathbf{6}_{EM}$ Solenoids
$\mathbf{6}S_1$ & $\mathbf{6}S_2$ Driven stops
6C Compression spring
8F Support frame
8G Extending groove
8L Flanged lip
8N Screw nuts
8T Set screws
8S Female slots
P Pulley
6P Support plate
8R Circular disc

What is claimed is:

1. An adjustable target throwing device adapted to throw one shooting target and multiple stacked shooting targets on a single throw, said device comprising:

a) a shooting target retaining member for retaining a column of stacked shooting targets for throwing by the device, b) a target dispensing unit adjustably equipped to dispense a desired number of shooting targets from said retaining member, c) a throwing unit equipped with a throwing arm which provides multiple longitudinally aligned guide sites positioned outwardly in an off-set and vertically staggered relationship along a longitudinal axis of the throwing arm so that only one site will make tangential contact with an uppermost shooting target of the desired number dispensed by the dispensing unit to the throwing unit, and d) a propelling member operationally connected to the throwing unit to propel the desired number along the longitudinal axis of the throwing arm to a target throwing position and thereby throw the desired number of the one shooting target or the multiple stacked shooting targets from the device to a targeting position.

2. The device according to claim 1 wherein the guide sites comprises a pair of guide rails positioned in a vertically and staggered arrangement along the longitudinal axis of the throwing arm with an upper guide rail of the pair being sufficiently positioned outwardly from the throwing arm so as to selectively make tangential contact onto the uppermost positioned shooting target when stacked targets are dispensed by the dispensing unit for throwing.

3. The device according to claim 2 wherein the device includes a remote control system for adjusting the dispensing unit to dispense the desired number of shooting targets.

4. The device according to claim 3 wherein the dispensing unit includes a plurality of laterally positioned stops vertically aligned so as to effectively serve as a restraining member upon the column of stacked shooting targets and thereby allow only the desired number of shooting targets onto the throwing unit when a desired stop of said plurality of stops is electromagnetically activated to a desired stopping position.

5. The device according to claim 2 wherein the shooting target retaining member comprises a vertical retaining column for retaining the stacked shooting targets and the dispensing unit includes a rotationally adjustable shaft equipped with a terminal stop positioned at an off-set position so as to only allow passage of the desired number of shooting targets to the throwing unit upon rotationally adjusting the stop to the desired number to be dispensed thereby.

6. The device according to claim 1 wherein the adjustable dispensing unit includes a mechanical adjustment member for adjusting the target dispersing unit to dispense the desired number of shooting targets.

7. The device according to claim 1 wherein the guide sites consists essentially of two guide rails longitudinally mounted in parallel alignment along the throwing arm in an increasingly outwardly projecting and ascending positioning of the guide rails and each rail includes an interfacing elastomeric surface to facilitate a rotational spin against the uppermost shooting target.

8. The device according to claim 7 wherein the dispensing unit is adjustable to dispense one or two shooting targets and the two guide rails are mounted upon the throwing arm in a sequential projecting pattern in which each ascending guide rail mounted to the throwing arm being positioned sufficiently outwardly from the throwing arm to selectively engage onto a rim of the uppermost shooting target of the desired number of shooting targets to be thrown by the throwing arm.

9. The device according to claim 1 wherein the guide sites consists of a plurality of outwardly projecting guide rails vertically and laterally spaced sufficiently apart so that only one rail of the plurality of the guide rails will selectively interfacially engage onto a rim of the uppermost shooting target of the desired number dispensed to the throwing unit.

10. The device according to claim 9 wherein the guide rails consist essentially of two guide rails each of which being equipped with an elastomeric surface for interfacially engaging onto the rim of the uppermost shooting target.

11. The device according to claim 1 wherein the throwing arm includes a multiplicity of guide rails serving as the guide sites with each guide rail having an elastomeric surface to facilitate a rotational spin against the uppermost shooting target.

12. The device according to claim 1 wherein the device includes a remote control system remotely adjustable to permit the target dispensing unit to dispense the desired number of shooting targets to the throwing unit.

13. The device according to claim 1 wherein a positioning of the guide sites is remotely controlled.

14. The device according to claim 13 wherein a guide site solenoid provides for the positioning of the guide sites.

15. A method for throwing shooting targets with an adjustable target throwing device adapted to throw a single shooting target and multiple stacked shooting targets on a single throw, said method comprising:

A. providing the target throwing device adjustable to simultaneously throw one or more shooting targets on a single throw, said device comprising
   a. a shooting target retaining member for retaining a column of stacked shooting targets for throwing by the device,
   b. a target dispensing unit adjustably equipped to dispense a desired number of shooting targets from said retaining member,
   c. a throwing unit equipped with a throwing arm which provides multiple longitudinally aligned guide sites positioned outwardly in an off-set and vertically staggered relationship along a longitudinal axis of the throwing arm so that only one site will make tangential contact with an uppermost shooting target of the desired number dispensed to the throwing unit, and;
   d. a propelling member operationally connected to the throwing unit to propel the desired number along the longitudinal axis of the throwing arm to a target throwing position and thereby throw the desired number of the one shooting target or the multiple stacked shooting targets from the device to a targeting position, B) adjusting the adjustable target dispensing unit to dispense the desired number of targets to be thrown by the device;

C) dispensing the desired number of targets to the throwing unit;

D) propelling the desired number of the shooting targets along the longitudinal axis of the throwing arm to a target throwing position, and E) throwing the desired number of shooting targets from said target throwing unit to the targeting position with the throwing including a simultaneously throwing of the multiple stacked shooting targets when the multiple stacked shooting targets are dispensed by the dispensing unit to the throwing unit.

16. The method according to claim 15 wherein the multiple guide sites comprises a plurality horizontally and laterally disposed guide rails mounted upon the throwing arm in a progressively outwardly ascending and lateral positioning so that only an uppermost guide rail of the guide rails makes tangential contact upon a rim of the uppermost shooting target dispensed to the throwing unit and the method includes the dispensing, the desired number of the multiple stacked shooting targets to the throwing arm, the propelling and the desired number of the multiple stacked shooting targets along the uppermost guide rail to the target throwing position.

17. The method according to claim 16 wherein the throwing arm is equipped with two guide rails and the target dispensing unit includes an adjustable stop for dispersing one or two shooting targets and the adjusting includes an adjustment of the adjustable stop to dispense the desired number of shooting targets to the throwing arm.

18. The method according to claim 15 wherein the adjustable target dispensing unit includes an adjustable stop adjustable to a plurality of stopping positions which upon operational engagement onto the stacked shooting targets retained by the target retaining member serves to allow only the desired number of the shooting targets to be dispensed thereby and the method includes the adjusting of the adjustable stop to the number of targets desired to be dispensed from the stacked shooting targets by the dispensing unit.

19. The method according to claim 15 wherein the throwing arm includes a horizontally adjustable rail serving as a positional guide site for making the tangential contact with the uppermost shooting target and the method includes setting the adjustable rail to the desired positional guide site for propelling the desired number of shooting targets along the longitudinal axis of the throwing arm.

20. The method according to claim 15 wherein the adjustable target dispensing unit is equipped with a plurality of electromagnetically operated stops aligned along a vertical axis in alignment with the column of stacked shooting targets retained by said retaining member and the adjusting of the target dispensing unit includes an operational engagement of one electromagnetic stop of the plurality of electromagnetically operated stops to permit the dispensing unit to dispense the desired number of shooting targets to the throwing arm.

* * * * *